US010748551B2

(12) United States Patent
Tsujikawa et al.

(10) Patent No.: US 10,748,551 B2
(45) Date of Patent: Aug. 18, 2020

(54) NOISE SUPPRESSION SYSTEM, NOISE SUPPRESSION METHOD, AND RECORDING MEDIUM STORING PROGRAM

(71) Applicant: NEC Corporation, Minato-ku, Tokyo (JP)

(72) Inventors: Masanori Tsujikawa, Tokyo (JP); Ryosuke Isotani, Tokyo (JP)

(73) Assignee: NEC CORPORATION, Tokyo (JP)

( * ) Notice: Subject to any disclaimer, the term of this patent is extended or adjusted under 35 U.S.C. 154(b) by 0 days.

(21) Appl. No.: 15/325,476

(22) PCT Filed: Jul. 16, 2015

(86) PCT No.: PCT/JP2015/003604
§ 371 (c)(1),
(2) Date: Jan. 11, 2017

(87) PCT Pub. No.: WO2016/009654
PCT Pub. Date: Jan. 21, 2016

(65) Prior Publication Data

US 2017/0169837 A1 Jun. 15, 2017

(30) Foreign Application Priority Data

Jul. 16, 2014 (JP) ..... 2014-145753

(51) Int. Cl.
*G10L 21/0232* (2013.01)

(52) U.S. Cl.
CPC ..... *G10L 21/0232* (2013.01)

(58) Field of Classification Search
CPC ..... G10L 21/0232
(Continued)

(56) References Cited

U.S. PATENT DOCUMENTS

RE40,281 E * 4/2008 Tzannes ..... 329/357
2002/0058505 A1* 5/2002 Kim ..... H04L 1/0015 455/427

(Continued)

FOREIGN PATENT DOCUMENTS

JP 2003-140700 A 5/2003
JP 2005-062890 A 3/2005

(Continued)

OTHER PUBLICATIONS

Handbook of Speech Processing, Chapter 44, Spectral Enhancement Methods, Springer, 2008, pp. 873-902.

(Continued)

*Primary Examiner* — Bharatkumar S Shah

(57) ABSTRACT

A noise suppression system includes an a priori S/N ratio estimated value and expectation calculation unit that acquires an expectation of a priori S/N ratio, by correcting an estimated value of the a priori S/N ratio relating to a signal and a noise based on a priori S/N ratio model or based on a signal model and a noise model, the signal and the noise being estimated from an input signal in which the signal and the noise are mixed; a noise suppression coefficient calculation unit that calculates a noise suppression coefficient with use of the expectation of the a priori S/N ratio; and a noise suppression unit that suppresses the noise included in the input signal by multiplying the input signal by the noise suppression coefficient.

11 Claims, 12 Drawing Sheets

(58) Field of Classification Search
USPC ..... 704/226
See application file for complete search history.

(56) References Cited

U.S. PATENT DOCUMENTS

| | | | | |
|---|---|---|---|---|
| 2004/0049383 | A1 | 3/2004 | Kato et al. | |
| 2005/0043945 | A1 | 2/2005 | Droppo et al. | |
| 2007/0027685 | A1* | 2/2007 | Arakawa | G10L 21/0208 704/226 |
| 2013/0138434 | A1* | 5/2013 | Furuta | G10L 21/0208 704/226 |
| 2015/0189432 | A1 | 7/2015 | Yuzuriha | |

FOREIGN PATENT DOCUMENTS

| | | | |
|---|---|---|---|
| JP | 2006-071956 | A | 3/2006 |
| JP | 2007-033920 | A | 2/2007 |
| JP | 4282227 | B2 | 6/2009 |
| JP | 4765461 | B2 | 9/2011 |
| JP | 2013-007975 | A | 1/2013 |
| JP | 2015-143811 | A | 8/2015 |

OTHER PUBLICATIONS

International Search Report for PCT Application No. PCT/JP2015/003604, dated Oct. 6, 2015.
English translation of Written opinion for PCT Application No. PCT/JP2015/003604.
Japanese Office Action for JP Application No. 2016-534288 dated Mar. 19, 2019 with English Translation.

* cited by examiner

NOISE SUPPRESSION SYSTEM, NOISE SUPPRESSION METHOD, AND RECORDING MEDIUM STORING PROGRAM

This application is a National Stage Entry of PCT/JP2015/003604 filed on Jul. 16, 2015, which claims priority from Japanese Patent Application 2014-145753 filed on Jul. 16, 2014, the contents of all of which are incorporated herein by reference, in their entirety.

TECHNICAL FIELD

The present invention relates to a noise suppression technology, and more particularly to a noise suppression system, a noise suppression method, and a program suitable for a system which extracts a desired signal by suppressing a noise component included in an input signal, usage thereof, and the like.

BACKGROUND ART

Development on a technology for acquiring a desired signal from an input signal in which the desired signal and noise are mixed has progressed. For instance, PTL 1 discloses a configuration, in which temporary estimated speech is obtained by suppressing noise included in an input speech signal, and the temporary estimated speech is corrected with use of a standard pattern of speech for making it possible to remove a noise component with high accuracy without lacking speech information. The technology of PTL 1 uses an expectation of temporary estimated speech, which is obtained by an expectation calculation processing using probabilities at which probability distributions constituting a standard pattern output temporary estimated speech, and using a mean of the probability distributions constituting the standard pattern, as a correction value of temporary estimated speech.

Note that PTL 2 and NPL 1 are described in example embodiments to be described later. PTL 2 discloses a method for removing noise. The noise removing method includes obtaining a first signal-to-noise ratio for each frequency first, obtaining a weight for each frequency based on the first signal-to-noise ratio, and obtaining estimated noise for each frequency based on a weighted frequency domain signal, which is obtained by applying a weight for each frequency to a frequency domain signal. The noise removing method further includes obtaining a second signal-to-noise ratio based on a frequency domain signal and estimated noise for each frequency, determining a suppression coefficient based on the second signal-to-noise ratio, and applying the suppression coefficient as a weight to the frequency domain signal.

CITATION LIST

Patent Literature

[PTL 1] Japanese Patent No. 4,765,461
[PTL 2] Japanese Patent No. 4,282,227

Non Patent Literature

[NPL 1] Handbook of Speech Processing, Chapter 44, Spectral Enhancement Methods, Springer, 2008, pp. 873-902

SUMMARY OF INVENTION

Technical Problem

In PTL 1, lack of speech information is prevented by correcting temporary estimated speech with use of a standard pattern of speech. However, accuracy of noise suppression may be decreased due to fluctuation of the magnitude of noise, or the like.

The present invention is made in view of the above problem, and an object of the present invention is to provide a technology for avoiding a decrease in the accuracy of noise suppression even when the magnitude of noise fluctuates with respect to an input signal in which noise is mixed in a desired signal, and suppressing a noise component with high accuracy.

Solution to Problem

In order to achieve the aforementioned object, a noise suppression system according to an aspect of the present invention, includes: an a priori S/N ratio estimated value and expectation calculation unit that applies correction to an estimated value of a priori S/N ratio relating to a signal and noise estimated from an input signal in which the signal and the noise are mixed, based on a priori S/N ratio model or based on a signal model and a noise model, and acquires an expectation of the a priori S/N ratio; a noise suppression coefficient calculation unit that calculates a noise suppression coefficient with use of the a priori S/N ratio expectation; and a noise suppression unit that suppresses the noise included in the input signal by multiplying the input signal by the noise suppression coefficient.

A noise suppression method according to another aspect of the present invention, includes: applying correction to an estimated value of a priori S/N ratio relating to a signal and noise estimated from an input signal in which the signal and the noise are mixed, based on a priori S/N ratio model or based on a signal model and a noise model, and acquiring an expectation of the a priori S/N ratio; calculating a noise suppression coefficient with use of the a priori S/N ratio expectation; and suppressing the noise component included in the input signal by multiplying the input signal by the noise suppression coefficient.

According to another aspect of the present invention, a program which causes a computer to execute: applying correction to an estimated value of a priori S/N ratio relating to a signal and noise estimated from an input signal in which the signal and the noise are mixed, based on the a priori S/N ratio model or based on a signal model and a noise model, and acquiring an expectation of a priori S/N ratio; calculating a noise suppression coefficient with use of the a priori S/N ratio expectation; and suppressing the noise component included in the input signal by multiplying the input signal by the noise suppression coefficient. According to the present invention, a non-transitory computer readable recording medium recording the program is provided.

Advantageous Effects of Invention

According to the present invention, it is possible to avoid a decrease in the accuracy of noise suppression even when the magnitude of noise fluctuates with respect to an input signal in which noise is mixed in a desired signal, and to suppress a noise component with high accuracy.

DESCRIPTION OF EMBODIMENTS

In the following, a basic idea common to the example embodiments of the present invention is described, and then, each of the example embodiments is described. Note that in the following description, it is needless to say that the reference signs in parenthesis merely illustrate an example for clarifying the basic idea of the present invention more, and are not to be construed for limiting the present invention. Further, in block diagrams illustrating the configurations of first to fourth example embodiments, directions of arrows between the blocks merely illustrate an example, and do not limit directions of signals between the blocks.

Figure 12:
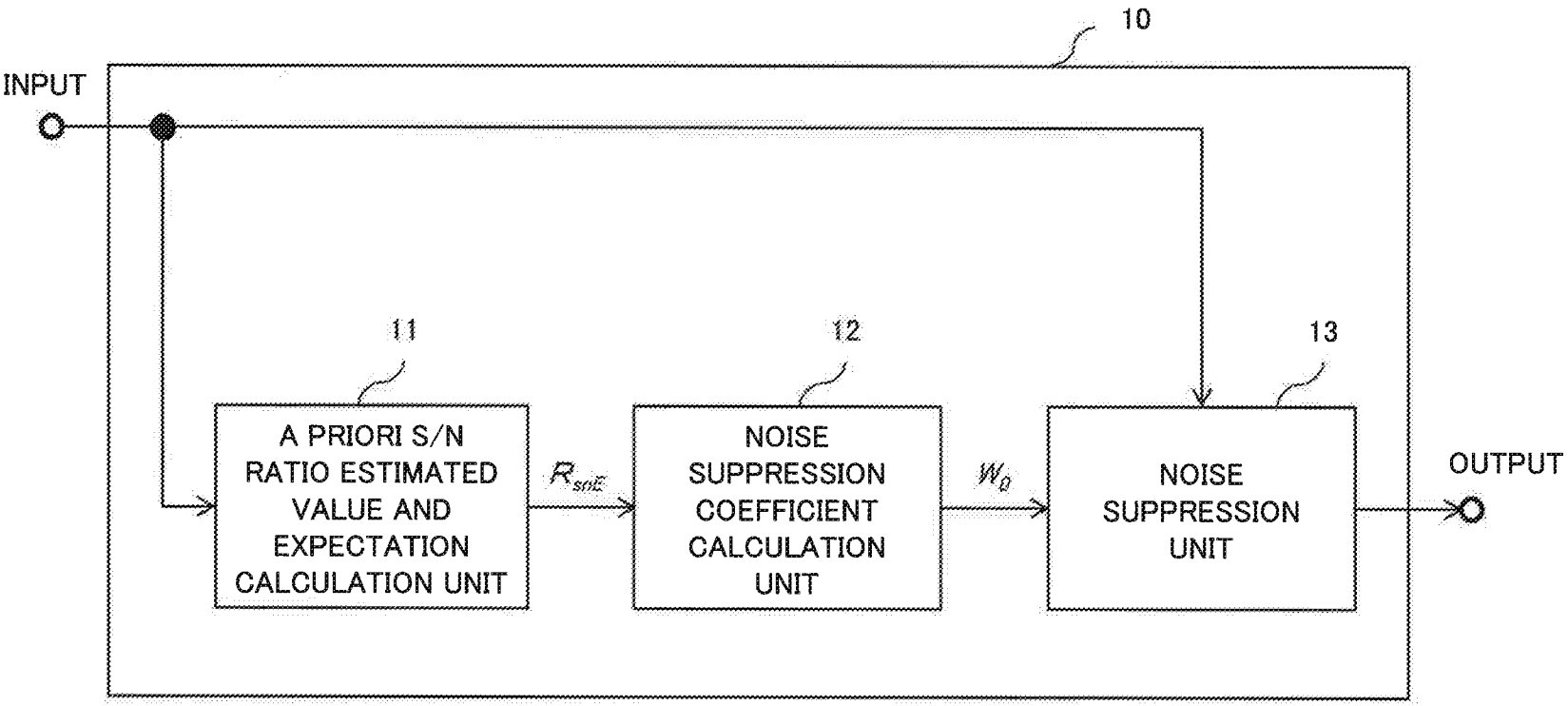
FIG. 12 is a diagram for describing a basic idea of the example embodiments of the present invention.

FIG. 12 is a diagram schematically and exemplarily illustrating a basic idea common to the example embodiments. Referring to FIG. 12, a noise suppression system (10) as an aspect of the present invention includes a priori S/N ratio estimated value and expectation calculation unit (11), a noise suppression coefficient calculation unit (12), and a noise suppression unit (13). The a priori S/N ratio estimated value and expectation calculation unit (11) applies correction to an estimated value of an S/N ratio of a signal to noise (a priori S/N ratio estimated value), which is estimated from an input signal in which the signal and the noise are mixed, and acquires a priori S/N ratio expectation ($R_{snE}$). The correction is based on a priori S/N ratio model, or based on a signal model and a noise model. Further, the noise suppression coefficient calculation unit (12) calculates a noise suppression coefficient ($W_0$) with use of a priori S/N ratio expectation ($R_{snE}$). Further, the noise suppression unit (13) suppresses a noise component included in an input signal by multiplying an input signal by a noise suppression coefficient ($W_0$), and outputs an estimated value of a signal. At least a part or all of the processes/functions of the respective units of the noise suppression system (10) may be implemented by a program to be executed on a computer constituting the noise suppression system (10).

Figure 1:
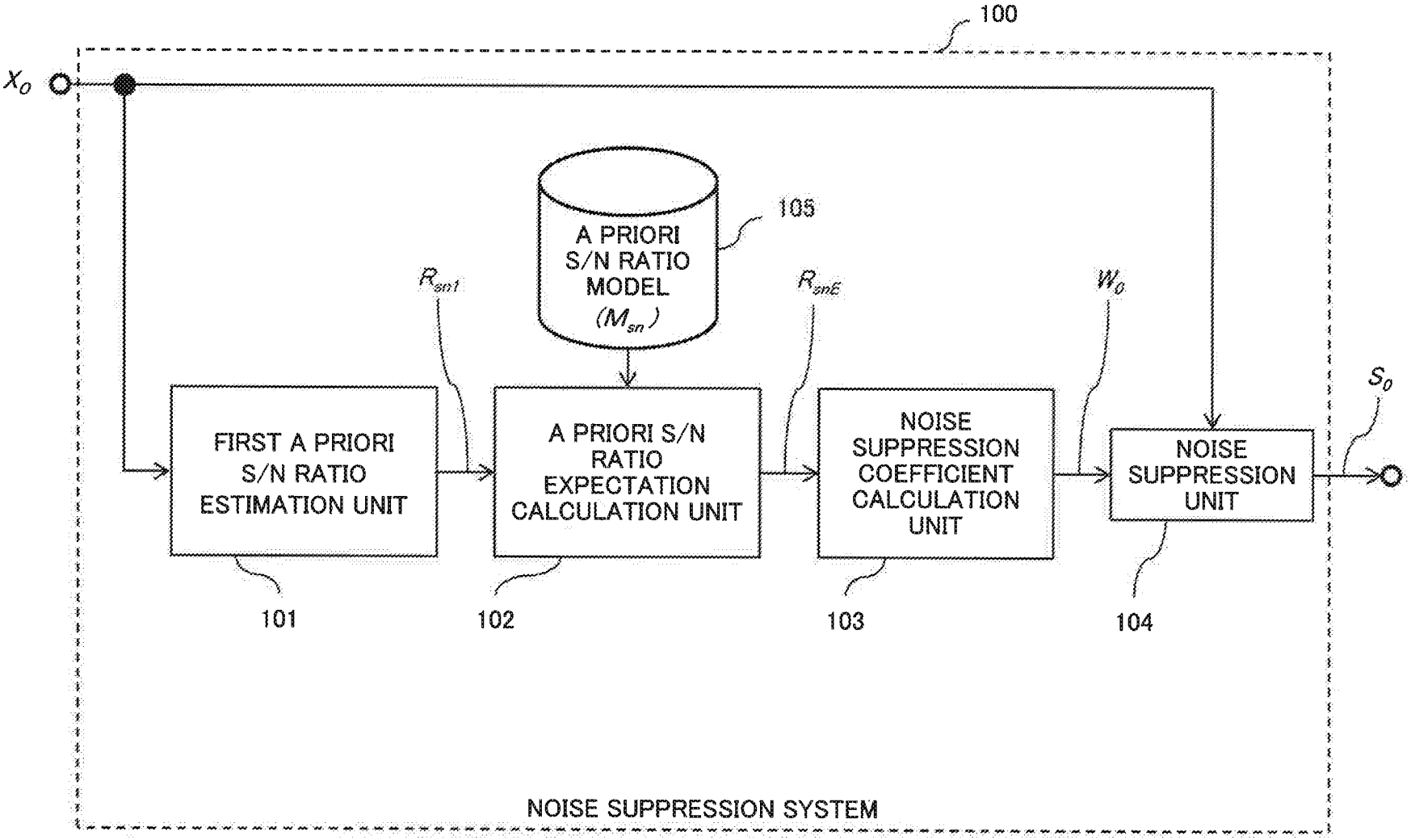
FIG. 1 is a diagram exemplarily illustrating a configuration of a noise suppression system according to a first example embodiment of the present invention.

According to a preferred example embodiment of the present invention, a noise suppression system (100 in FIG. 1) includes a first a priori S/N ratio estimation unit (101 in FIG. 1), a storage unit (105 in FIG. 1), and an a priori S/N ratio expectation calculation unit (102 in FIG. 1). The first a priori S/N ratio estimation unit (101) receives an input signal in which a signal and noise are mixed, estimates the signal and the noise from the input signal, and estimates a priori S/N ratio relating to the estimated signal and the estimated noise. The storage unit (105) stores a priori S/N ratio model ($M_{sn}$) prepared in advance. The a priori S/N ratio expectation calculation unit (102) calculates a priori S/N ratio expectation ($R_{snE}$) by correcting a priori S/N ratio estimated by the first a priori S/N ratio estimation unit (101) with use of a priori S/N ratio model stored in the storage unit (105). The noise suppression coefficient calculation unit (103 in FIG. 1) calculates a noise suppression coefficient ($W_0$) with use of a priori S/N ratio expectation ($R_{snE}$). The noise suppression unit (104 in FIG. 1) suppresses a noise component included in an input signal by multiplying the input signal by a noise suppression coefficient ($W_0$), and outputs an estimated value of a signal. Note that the first a priori S/N ratio estimation unit (101), the storage unit (105), and the a priori S/N ratio expectation calculation unit (102) correspond to the a priori S/N ratio estimated value and expectation calculation unit (11) in FIG. 12.

According to another example embodiment of the present invention, a priori S/N ratio model may be estimated with use of a speech model prepared in advance and a noise model prepared in advance, in place of using a priori S/N ratio model prepared in advance. For instance, the noise suppression system (300 in FIG. 6) includes a first speech and first noise estimation unit (305 in FIG. 6), a storage unit (307 in FIG. 6), a storage unit (308 in FIG. 6), and an a priori S/N ratio expectation calculation unit (306 in FIG. 6). The first speech and first noise estimation unit (305) receives an input signal in which a signal and noise are mixed, and estimates the signal and the noise from the input signal. The storage unit (307) stores a speech model ($M_s$) prepared in advance. The storage unit (308) stores a noise model ($M_n$) prepared in advance. The a priori S/N ratio expectation calculation unit (306) receives a signal and noise estimated by the first speech and first noise estimation unit (305), corrects a priori S/N ratio of the signal to the noise with use of a speech model and a noise model respectively stored in the storage units (307, 308), and calculates a priori S/N ratio expectation ($R_{snE}$). The noise suppression coefficient calculation unit (303 in FIG. 6) calculates a noise suppression coefficient ($W_0$) with use of a priori S/N ratio expectation ($R_{snE}$). The noise suppression unit (304 in FIG. 6) suppresses a noise component included in an input signal by multiplying the input signal by a noise suppression coefficient ($W_0$), and outputs an estimated value of a signal. Note that the first speech and first noise estimation unit (305), the storage units (307, 308), and the a priori S/N ratio expectation calculation unit (306) correspond to the a priori S/N ratio estimated value and expectation calculation unit (11) in FIG. 12.

Alternatively, according to another example embodiment of the present invention, a noise suppression system (400 in FIG. 9) includes a first speech and first noise estimation unit (405 in FIG. 9) which receives an input signal in which a signal and noise are mixed, and estimates the signal and the noise from the input signal, and a storage unit (407 in FIG. 9) which stores a speech model prepared in advance. The noise suppression system (400) further includes an a priori S/N ratio expectation calculation unit (406 in FIG. 9). The a priori S/N ratio expectation calculation unit (406) receives a signal and noise estimated by the first speech and first noise estimation unit (405 in FIG. 9), generates a noise model ($M_n$) based on noise, and corrects a ratio of the signal to the noise (a priori S/N ratio) with use of a speech model and a noise model. According to this configuration, the a priori S/N ratio expectation calculation unit (406) calculates a priori S/N ratio expectation ($R_{snE}$). The noise suppression coefficient calculation unit (403 in FIG. 9) calculates a noise suppression coefficient with use of a priori S/N ratio expectation. The noise suppression unit (404 in FIG. 9) may be configured to suppress a noise component included in an input signal by multiplying the input signal by a noise suppression coefficient, and to output an estimated value of a signal. Note that the first speech and first noise estimation unit (405), the storage unit (407), and the a priori S/N ratio expectation calculation unit (406) correspond to the a priori S/N ratio estimated value and expectation calculation unit (11) in FIG. 12. In the following, example embodiments of the present invention will be described in detail referring to the drawings. Note that constituent elements described in the following example embodiments merely illustrate an example. It is needless to say that the present invention is not limited to these configurations.

First Example Embodiment

FIG. 1 is a diagram exemplarily illustrating a configuration of a noise suppression system 100 according to a first example embodiment. Referring to FIG. 1, the noise suppression system 100 as the first example embodiment of the present invention is described. As illustrated in FIG. 1, the noise suppression system 100 includes a first a priori S/N ratio estimation unit 101, an a priori S/N ratio expectation calculation unit 102, a noise suppression coefficient calculation unit 103, a noise suppression unit 104, and a storage unit 105 which stores a priori S/N ratio model ($M_{sn}$).

A priori S/N ratio and an after S/N ratio are distinguishably defined as follows.

A priori S/N ratio=desired signal power/noise power

After S/N ratio=(mixed signal power of desired signal and noise)/noise power

The first a priori S/N ratio estimation unit 101 receives an input signal $X_0$ in which a desired signal and noise are mixed. The first a priori S/N ratio estimation unit 101 estimates a ratio (a priori S/N ratio) $R_{sn1}$ of desired signal power and noise power, which are included in an input signal $X_0$, and outputs an estimated a priori S/N ratio $R_{sn1}$. Note that an input signal $X_0$ is a frequency spectrum (a frequency amplitude spectrum, a frequency power spectrum, or the like) of a mixed signal in which a desired signal and noise are mixed, and is a signal in a frequency domain (a complex signal including a real part and an imaginary part), which is obtained by applying discrete Fourier transform (DFT) or the like to a signal in a time domain. Further, an input signal $X_0$ to be described in the following example embodiments is obtained in the same manner as described above.

The a priori S/N ratio expectation calculation unit 102 receives a priori S/N ratio $R_{sn1}$ output from the first a priori S/N ratio estimation unit 101, and a priori S/N ratio model $M_{sn}$ stored in advance in the storage unit 105. The a priori S/N ratio model $M_{sn}$ is constituted by a priori S/N ratio pattern. The a priori S/N ratio expectation calculation unit 102 compares between a priori S/N ratio $R_{sn1}$ and a priori S/N ratio model $M_{sn}$, and outputs a value obtained by correcting the a priori S/N ratio $R_{sn1}$ by the a priori S/N ratio model $M_{sn}$, as a priori S/N ratio expectation $R_{snE}$.

The noise suppression coefficient calculation unit 103 receives a priori S/N ratio expectation $R_{snE}$ output from the a priori S/N ratio expectation calculation unit 102. The noise suppression coefficient calculation unit 103 calculates a noise suppression coefficient $W_0$ with use of a priori S/N ratio expectation $R_{snE}$, and outputs the noise suppression coefficient $W_0$.

The noise suppression unit 104 receives a noise suppression coefficient $W_0$ output from the noise suppression coefficient calculation unit 103, and an input signal $X_0$. The noise suppression unit 104 suppresses a noise component included in an input signal $X_0$ by multiplying the input signal $X_0$ by a noise suppression coefficient $W_0$, and outputs an estimated value $S_0$ of a desired signal.

In the first example embodiment, the first a priori S/N ratio estimation unit 101, the a priori S/N ratio expectation calculation unit 102, the noise suppression coefficient calculation unit 103, the noise suppression unit 104, and the storage unit 105 may be integrally mounted in a single device. Alternatively, each of the units may be configured as a distributed system to be connected to each other via a communication means such as a network. Further, at least a part of the processes/functions of the first a priori S/N ratio estimation unit 101, the a priori S/N ratio expectation calculation unit 102, and the noise suppression coefficient calculation unit 103 may be implemented by a program to be executed on a computer. Further, at least a part of the processes/functions of the noise suppression unit 104, and the storage unit 105 (read control, write control) may be implemented by a program to be executed on a computer. The same idea as described above is also applied to the other example embodiments.

According to the first example embodiment, a priori S/N ratio $R_{sn1}$ is corrected by a priori S/N ratio model $M_{sn}$ taking into consideration fluctuation of the magnitude of noise. It is possible to suppress a noise component with high accuracy without removing a desired signal component even when the magnitude of noise fluctuates, by multiplying an input signal $X_0$ by a noise suppression coefficient $W_0$ calculated with use of a priori S/N ratio expectation $R_{snE}$.

Second Example Embodiment

Figure 3:
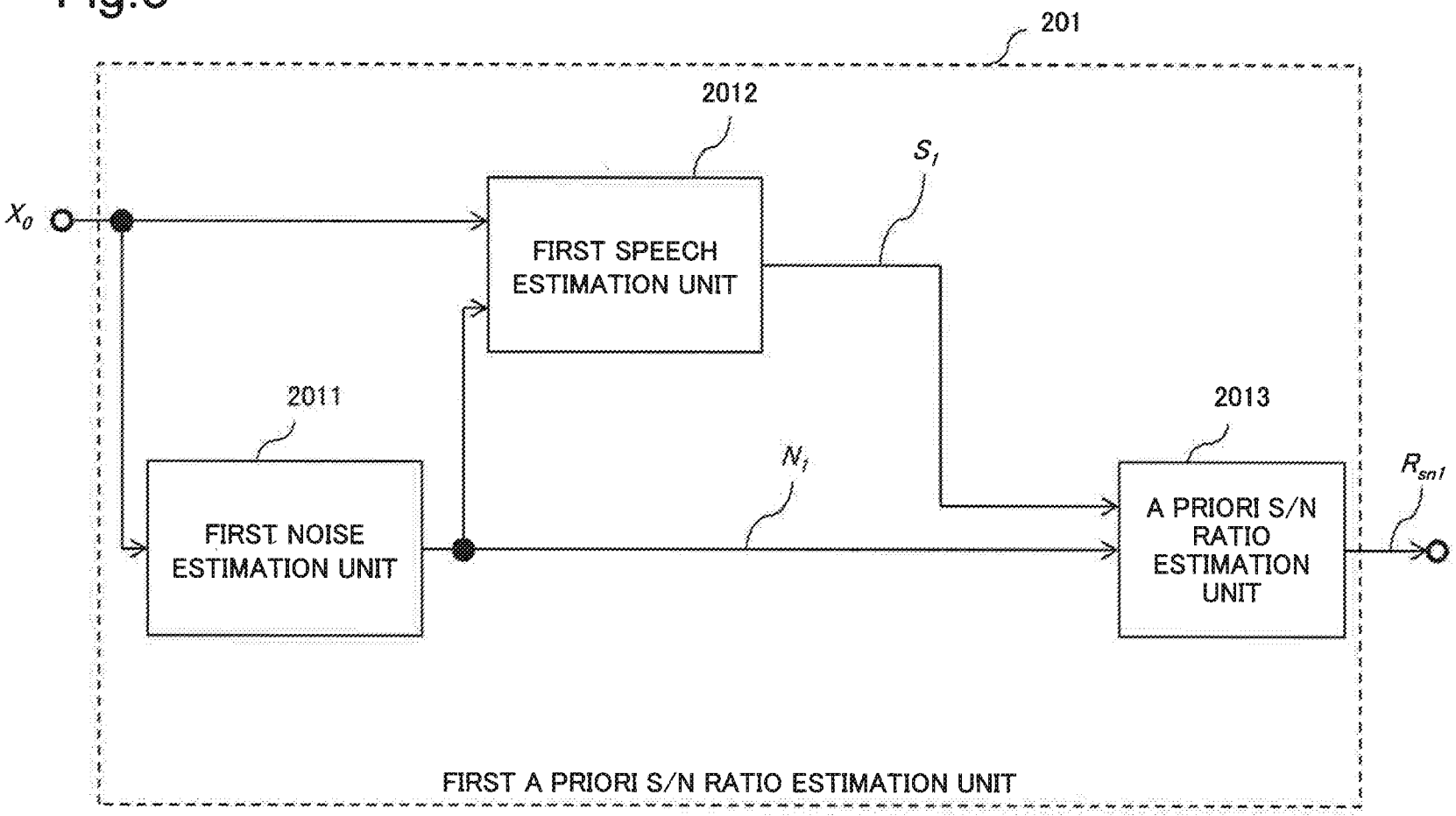
FIG. 3 is a diagram exemplarily illustrating a configuration of a first a priori S/N ratio estimation unit according to the second example embodiment of the present invention.
Figure 4:
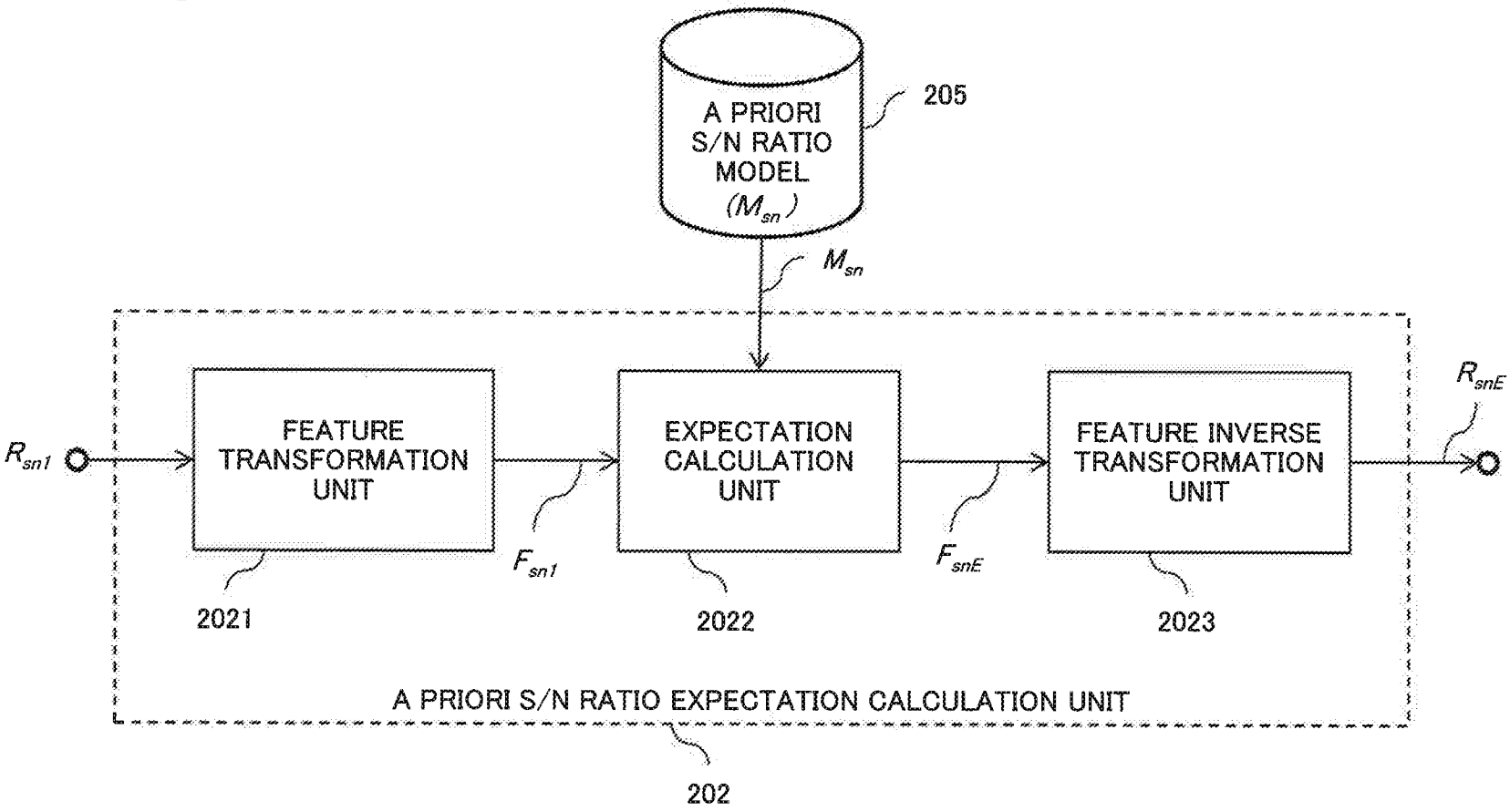
FIG. 4 is a diagram exemplarily illustrating a configuration of an a priori S/N ratio expectation calculation unit according to the second example embodiment of the present invention.
Figure 5:
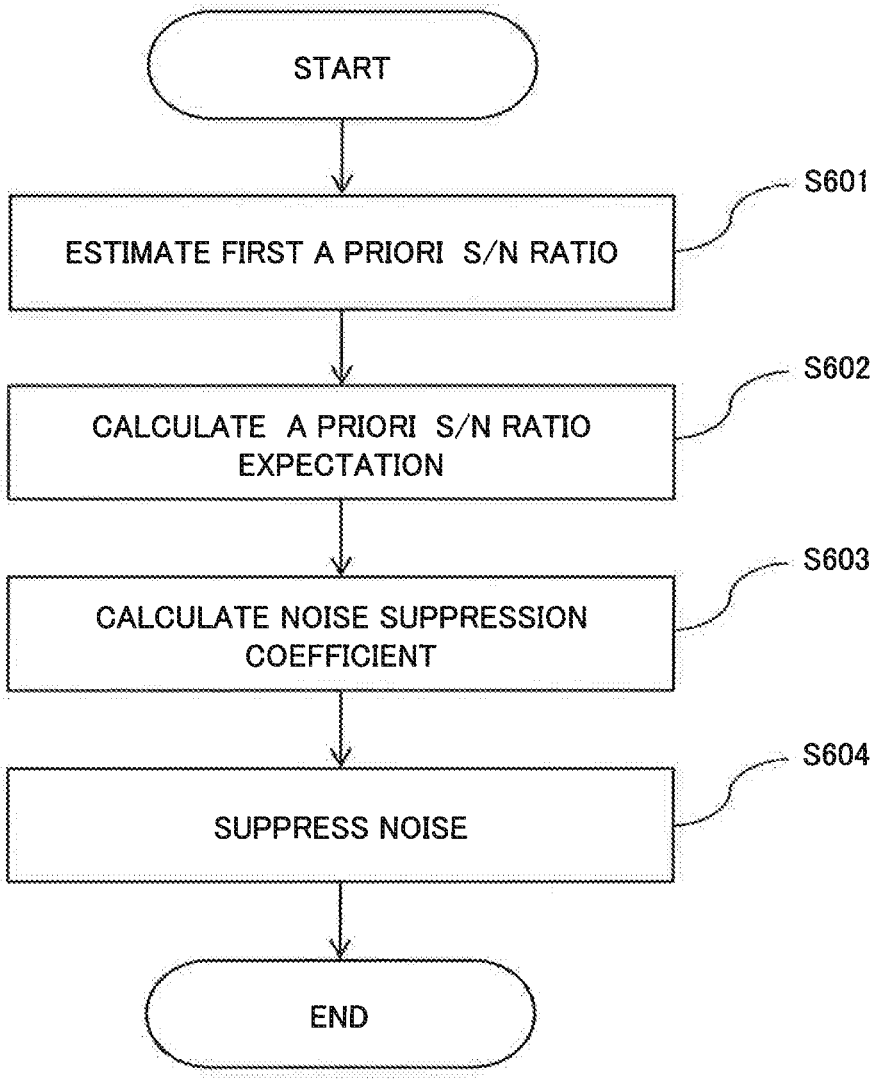
FIG. 5 is a flowchart for describing a processing sequence of the noise suppression system according to the second example embodiment of the present invention.

Next, a noise suppression system 200 according to the second example embodiment of the present invention is described referring to FIG. 2 to FIG. 5. Note that FIG. 5 is a flowchart illustrating a process of a noise suppression system of the second example embodiment.

(Overall Configuration)

Figure 2:
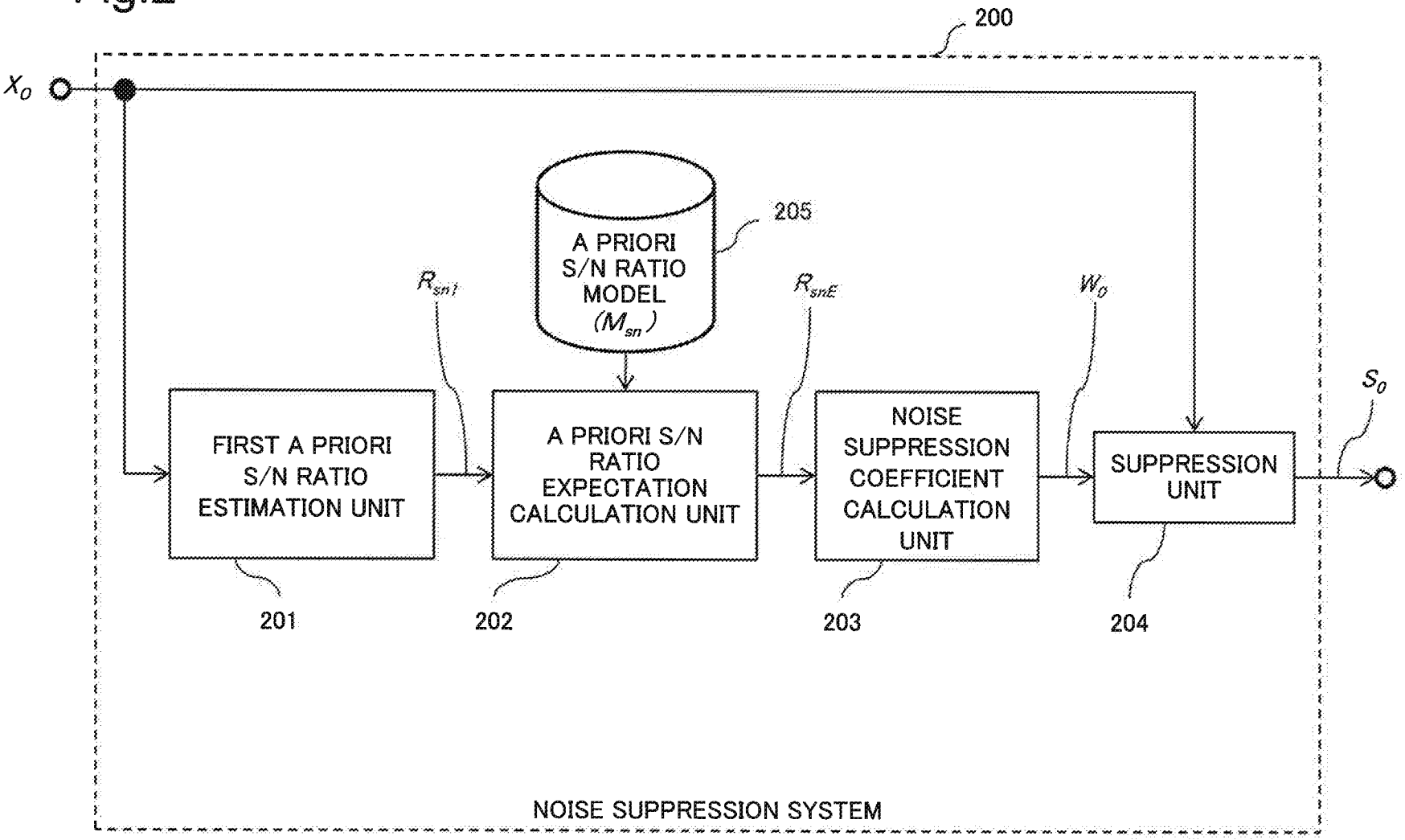
FIG. 2 is a diagram exemplarily illustrating a configuration of a noise suppression system according to a second example embodiment of the present invention.

FIG. 2 is a diagram exemplarily illustrating a configuration of the noise suppression system 200 according to the second example embodiment. The noise suppression system 200 according to the second example embodiment acquires (extracts) a desired signal from a mixed signal in which the desired signal and noise are mixed. In the following example, a desired signal is described as a speech signal. It is needless to say, however, that a desired signal is not limited to a speech signal.

The noise suppression system 200 includes a first a priori S/N ratio estimation unit 201, an a priori S/N ratio expectation calculation unit 202, a noise suppression coefficient calculation unit 203, a noise suppression unit 204, and a storage unit 205 which stores a priori S/N ratio model (a priori S/N ratio pattern) $M_{sn}$ in advance.

The first a priori S/N ratio estimation unit 201 receives an input signal $X_0$ in which a desired signal and noise are mixed. Then, the first a priori S/N ratio estimation unit 201 estimates a ratio (a priori S/N ratio) $R_{sn1}$ of desired signal power and noise power, which are included in the input signal $X_0$, and outputs the estimated $R_{sn1}$.

The a priori S/N ratio expectation calculation unit 202 receives a priori S/N ratio $R_{sn1}$ output from the first a priori S/N ratio estimation unit 201, and a priori S/N ratio model $M_{sn}$ stored and held in advance in the storage unit 205. The a priori S/N ratio expectation calculation unit 202 compares between the estimated a priori S/N ratio $R_{sn1}$ and the a priori S/N ratio model $M_{sn}$, and outputs a priori S/N ratio expectation $R_{snE}$, which is a value corrected by the a priori S/N ratio model $M_{sn}$.

The noise suppression coefficient calculation unit 203 receives an output $R_{snE}$ from the a priori S/N ratio expectation calculation unit 202. The noise suppression coefficient calculation unit 203 calculates a noise suppression coefficient $W_0$ with use of a priori S/N ratio expectation $R_{snE}$, and outputs $W_0$.

The noise suppression unit 204 receives a noise suppression coefficient $W_0$ output from the noise suppression coefficient calculation unit 203, and an input signal $X_0$. The noise suppression unit 204 suppresses a noise component included in an input signal by multiplying the input signal $X_0$ by a noise suppression coefficient $W_0$, and outputs an estimated value $S_0$ of a desired signal.

In the following, each of the units of the noise suppression system 200 in FIG. 2 is described in further detail.

(First A Priori S/N Ratio Estimation Unit)

First of all, a process of the first a priori S/N ratio estimation unit 201 in FIG. 2 is described. An input signal $X_0$ in which a desired signal and noise are mixed is modeled as expressed by the following (Equation 1).

$$X_0(f,t)=S(f,t)+N(f,t) \quad \text{(Equation 1)}$$

Note that $X_0(f, t)$ is a frequency spectrum (a frequency amplitude spectrum, a frequency power spectrum, or the like) of a mixed signal in which a desired signal and noise are mixed. The frequency spectrum is a signal in a frequency domain (a complex signal including a real part and an imaginary part), which is obtained by applying discrete Fourier transform (DFT) or the like to a signal in a time domain, for instance. A power component is obtained by performing a square operation i.e. multiplying an amplitude component, an amplitude component by absolute value calculation. The parameter f is a frequency index (the frequency index is, for instance, from a DC (direct-current) component (index: 0) to a Nyquist frequency), and the parameter t is a time (discrete time) index. Further, $X_0$, S, and N at the time index t are vectors, each of which has a component in a frequency direction as an element.

The parameter S on the right side is a frequency spectrum of a desired speech component.

Further, N is a frequency spectrum of a noise component.

FIG. 3 is a diagram exemplarily illustrating a configuration of the first a priori S/N ratio estimation unit 201. Referring to FIG. 3, the first a priori S/N ratio estimation unit 201 includes a first noise estimation unit 2011, a first speech estimation unit 2012, and a priori S/N ratio estimation unit 2013.

The first noise estimation unit 2011 receives an input signal $X_0$, estimates a noise component included in the input signal $X_0$, and outputs first estimated noise $N_1$.

The first speech estimation unit 2012 receives an input signal $X_0$ and first estimated noise $N_1$, and outputs first estimated speech $S_1$.

The a priori S/N ratio estimation unit 2013 receives the first estimated speech $S_1$ and the first estimated noise $N_1$, and outputs an estimated a priori S/N ratio $R_{sn1}(=S_1/N_1)$. Note that $S_1$ and $N_1$ at the time index t are vectors, each of which has a component in a frequency direction as an element.

(First Noise Estimation Unit)

The first noise estimation unit 2011 estimates a noise component included in an input signal $X_0$, and outputs first estimated noise $N_1$.

$$N_1=\mathrm{NE}[X_0] \quad \text{(Equation 2)}$$

Note that NE[ ] denotes a noise estimator. It is possible to use a minimum statistics method, a weighed noise estimation method, or the like, all of which are well-known methods for estimation of a noise component included in an input signal $X_0$. Note that the right side of Equation 2 is calculated for each component of a vector $X_0$ by the noise estimator NE[ ], and are outputs with respect to the each component of the vector $X_0$. In this example, the output with respect to the component of the vector $X_0$ means: $y_i=\mathrm{NE}[x_i]$ (where $y_i$ denotes the i-th component of an output vector, and $x_i$ denotes the i-th component of a vector $X_0$).

(First Speech Estimation Unit)

The first speech estimation unit 2012 estimates a speech component included in an input signal $X_0$ by suppressing a noise component included in the input signal $X_0$, and outputs first estimated speech $S_1$.

$$S_1=\mathrm{NS}[X_0,N_1] \quad \text{(Equation 3)}$$

Note that NS[ ] denotes a noise suppressor. For instance, a spectral subtraction (SS) method described in NPL 1 may be used. The right side of Equation 3 is calculated for each component of a vector $X_0$ and for each component of a vector $N_1$ by the noise suppressor NS[ ], and are outputs with respect to each component of the vector $X_0$ and a component of the vector $N_1$. In this example, the output with respect to the component of the vector means: $y_i=\mathrm{NS}[X_i, N_i]$ (where $y_i$ denotes the i-th component of an output vector, and $X_i$ and $N_i$ denote the i-th components of a vector $X_i$ and a vector $N_1$). In addition to the above, a Wiener Filter (WF) method, an MMSE STSA (Minimum Mean Square Error Short Time Spectral Amplitude) method, an MMSE LSA (Minimum Mean Square Error Log Spectral Amplitude) method, or the like may be used.

(A Priori S/N Ratio Estimation Unit)

The a priori S/N ratio estimation unit 2013 receives first estimated speech $S_1$ (a speech component included in an input signal $X_0$) from the first speech estimation unit 2012, and first estimated noise $N_1$ from the first noise estimation unit 2011, estimates an S/N ratio $(=S_1/N_1)$ of a speech signal to noise, and outputs the estimated value as a priori S/N ratio $R_{sn1}$.

$$R_{sn1} = \frac{S_1}{N_1} \quad \text{(Equation 4)}$$

The right side of Equation 4 is calculated for each component of a vector $S_1$ and for each component of a vector $N_1$, and are outputs with respect to the each component of the vector $S_1$ and the each component of the vector $N_1$. For instance, $S_1/N_1$ is output like ($S_{11}/N_{11}$, $S_{12}/N_{11}$, . . . , $S_{1n}/N_{1n}$). The output with respect to the component of the vector means: $y_i=x_i/z_i$ (where $y_i$ denotes the i-th component of an output vector, and $x_i$, and $z_i$ denote the i-th components of a vector $S_1$ and a vector $N_1$).

Note that in the a priori S/N ratio estimation unit 2013, first estimated noise $N_1$ of the denominator on the right side of (Equation 4) may be a noise component $N_1'(=X_0-S_1)$, which is re-estimated with use of an input signal $X_0$ and first estimated speech $S_1$. In this case, a priori S/N ratio $R_{sn1}$ is given by the following (Equation 5).

$$R_{sn1} = \frac{S_1}{N_1'} = \frac{S_1}{X_0 - S_1} \quad \text{(Equation 5)}$$

The right side of Equation 5 is also calculated for each component of a vector $X_0$ and for each component of a vector $S_1$ in the same manner as described above. Further, when the WF method, the MMSE STSA method, or the MMSE LSA method is used in the first speech estimation unit 2012, the first speech estimation unit 2012 may obtain a priori S/N ratio. In view of the above, a priori S/N ratio estimated by the first speech estimation unit 2012 may be regarded as an output (a priori S/N ratio $R_{sn1}$) of the first a priori S/N ratio estimation unit 201. In this case, the a priori S/N ratio estimation unit 2013 in FIG. 3 is unnecessary.

A priori S/N ratio $R_{sn1}$ may be calculated, for instance, with use of a value for each frequency band B (e.g. a Mel-frequency band), which is a series of frequency indexes f in (Equation 7), or with use of a value obtained by summing up all the frequency indexes f in (Equation 8), in addition to a value for each frequency index f in the following (Equation 6). Note that a priori S/N ratio $R_{sn1}$ at the time index t exists by the number equal to the number of frequency indexes f or the number of frequency bands B. Therefore, a priori S/N ratio $R_{sn1}$ at t is a vector which has a component in a frequency direction as an element.

$$R_{sn1}(f, t) = \frac{S_1(f, t)}{N_1(f, t)} \quad \text{(Equation 6)}$$

$$R_{sn1}(B, t) = \frac{\sum_{f \in B} S_1(f, t)}{\sum_{f \in B} N_1(f, t)} \quad \text{(Equation 7)}$$

$$R_{sn1}(t) = \frac{\sum_{\forall f} S_1(f, t)}{\sum_{\forall f} N_1(f, t)} \quad \text{(Equation 8)}$$

(A Priori S/N Ratio Expectation Calculation Unit)

FIG. 4 is a diagram exemplarily illustrating a configuration of the a priori S/N ratio expectation calculation unit 202 in FIG. 2. Referring to FIG. 4, the a priori S/N ratio expectation calculation unit 202 includes a feature transformation unit 2021, an expectation calculation unit 2022, and a feature inverse transformation unit 2023.

The feature transformation unit 2021 receives a priori S/N ratio $R_{sn1}$ output from the first a priori S/N ratio estimation unit 201, and outputs a feature $F_{sn1}$ of the a priori S/N ratio $R_{sn1}$.

The expectation calculation unit 2022 receives the feature $F_{sn1}$, and a priori S/N ratio model (a priori S/N ratio pattern) $M_{sn}$ prepared in advance, and outputs a feature $F_{snE}$ of a priori S/N ratio expectation.

The feature inverse transformation unit 2023 receives the feature $F_{snE}$, and outputs a priori S/N ratio expectation $R_{snE}$.

(Feature Transformation Unit)

The feature transformation unit 2021 transforms a priori S/N ratio $R_{sn1}$ into a feature $F_{sn1}$, and outputs the feature $F_{sn1}$. As a feature, it is possible to use a logarithmic value in the following (Equation 9), a value (cepstrum) obtained by applying discrete cosine transform (DCT) to a logarithmic value, as expressed by (Equation 10), or the like, for instance.

$$F_{sn1} = \log R_{sn1} \quad \text{(Equation 9)}$$

Note that log expressed by Equation 9 is a natural logarithm. The same definition is applied to log that is described hereinafter. Note that log may employ a common logarithm in addition to a natural logarithm. Note that the right side of Equation 9 is logarithmically calculated for each component of a vector $R_{sn1}$, and are outputs with respect to the each component of the vector $R_{sn1}$. In this example, the output with respect to the component of the vector $R_{sn1}$ means: $y_i=\log x_i$ (where $y_i$ denotes the i-th component of an output vector, and $x_i$ denotes the i-th component of a vector $R_{sn1}$).

$$F_{sn1} = C[\log R_{sn1}] \quad \text{(Equation 10)}$$

Note that C[ ] denotes a DCT operator. The right side of Equation 10 is subjected to cosine transform for each component of a vector $\log R_{sn1}$, and are outputs with respect to the each component of the vector $R_{sn1}$. In this example, the output with respect to the component of the vector $R_{sn1}$ means: $z_i=C[x_i]$ (where $z_i$ denotes the i-th component of an output vector, and $x_i$ denotes the i-th component of the vector $R_{sn1}$). Further, logarithmic computation in Equation 10 is the same as the calculation in Equation 9.

Note that a feature $F_{sn1}$ may be calculated for each time index t. Alternatively, a difference with respect to a feature at a past time (e.g., t−1) may be obtained, and a primary difference feature may be used. Further alternatively, a further difference may be obtained, and a secondary difference feature may be used. There exist features $F_{sn1}$ at the time index t by the number equal to the number of dimensions of cepstrum, the number of primary difference features, or the number of secondary difference features. Therefore, a feature $F_{sn1}$ at the time index t is a multi-dimensional vector.

(Expectation Calculation Unit)

The expectation calculation unit 2022 receives a feature $F_{sn1}$, and a priori S/N ratio model $M_{sn}$ stored in advance in the storage unit 205, and outputs a feature $F_{snE}$ of a priori S/N ratio expectation. In the following, as an example, a priori S/N ratio model $M_{sn}$ is described as a Gaussian mixture model (GMM), which is constituted by Gaussian distributions whose number is G. Note that it is needless to say that the present invention is not limited to the following example.

A priori S/N ratio model $M_{sn}$ is regarded as a Gaussian mixture model such that Gaussian distributions whose number is G (G>1) with an average value $\mu_{sn,g}$ and a dispersion $\sigma^2_{sn,g}$ are mixed with a weight $w_{sn,g}$. Note that g is an index of Gaussian distribution (g=0, 1, . . . , G−1).

The expectation calculation unit 2022 calculates a feature $F_{snE}$ of a priori S/N ratio expectation as a weighted sum of average values $\mu_{sn,g}$ of a priori S/N ratio models $M_{sn}$ as expressed by the following (Equation 11).

$$F_{snE}=\Sigma_{g=0}^{G-1}P(g|F_{sn1})\mu_{sn,g} \quad \text{(Equation 11)}$$

In (Equation 11), $P(g|F_{sn1})$ as a weight is a posterior probability with respect to a feature $F_{sn1}$. $P(g|F_{sn1})$ is calculated as expressed by (Equation 12), for instance.

$$P(g \mid F_{sn1}) = \frac{w_{sn,g}P(F_{sn1} \mid g)}{\sum_{g=0}^{G-1} w_{sn,g}P(F_{sn1} \mid g)} \quad \text{(Equation 12)}$$

In (Equation 12), $P(F_{sn1}|g)$ is a probability at which a Gaussian distribution g of a priori S/N ratio model $M_{sn}$ outputs a feature $F_{sn1}$, and is calculated as expressed by the following (Equation 13).

$$P(F_{sn1} \mid g) = \frac{1}{(\sqrt{2}\pi)^D\sqrt{\det[\sigma_{sn,g}^2]}} \exp\left(-\frac{1}{2}\{F_{sn1}-\mu_{sn,g}\}^T(\sigma_{sn,g}^2)^{-1}\{F_{sn1}-\mu_{sn,g}\}\right) \quad \text{(Equation 13)}$$

Note that both of a feature $F_{sn1}$ and an average value $\mu_{sn,g}$ are D-dimensional column vectors, and a dispersion $\sigma^2_{sn,g}$ is a D×D matrix. The parameter det[ ] denotes a determinant operator. Further, T denotes transposition, and $\{F_{sn1}-\mu_{sn,g}\}^T$ denotes a D-dimensional row vector. Note that the value of D representing the number of dimensions may be changed as necessary depending on the type of an input signal. When a speech signal is included, ten or more dimensions may be desirable.

A priori S/N ratio model $M_{sn}$ stored and held in advance in the storage unit 105 is expressed by using an average value $\mu_{sn,g}$ and a dispersion $\sigma^2_{sn,g}$. The dispersion $\sigma^2_{sn,g}$ includes fluctuation of a speech signal or fluctuation of the magnitude of noise. In view of the above, in (Equation 11), a posterior probability $P(g|F_{sn1})$ to be used as a weight is a value taking into consideration fluctuation of the magnitude of noise.

A priori S/N ratio model $M_{sn}$ may be generated with use of a feature $F_{sn1}$ with respect to a large amount of input signals in advance. In the case of a Gaussian mixture model, a priori S/N ratio model $M_{sn}$ may be learnt (generated) with use of an expectation maximization algorithm or the like, for instance. Alternatively, a priori S/N ratio model $M_{sn}$ may be generated by combining a speech model $M_s$ and a noise model $M_n$. A method for combining a speech model $M_s$ and a noise model $M_n$ will be described in the next example embodiment (refer to the description on an expectation calculation unit 3062 in FIG. 8).

(Feature Inverse Transformation Unit)

The feature inverse transformation unit 2023 transforms a feature $F_{snE}$ of a priori S/N ratio expectation, and outputs a priori S/N ratio expectation $R_{snE}$. When a logarithmic value in (Equation 9) is used by the feature transformation unit 2021, inverse transformation is applied by (Equation 14). When a value obtained by applying cosine transform to a logarithmic value is used as expressed by (Equation 10), inverse transformation may be applied by (Equation 15).

$$R_{snE}=\exp[F_{snE}] \quad \text{(Equation 14)}$$

$$R_{snE}=\exp[C^{-1}[F_{snE}]] \quad \text{(Equation 15)}$$

Note that exp[ ] denotes an exponential operator, and $C^{-1}$[ ] denotes an inverse cosine transform operator (inverse discrete cosine transform (IDCT) operator). Note that the right side of Equation 14 may be expressed as $\exp[F_{snE}]$, which is an exp function. The right side is calculated for each component of a vector $F_{snE}$, and is output corresponding to a vector component like ($e^{FsnE1}$, $e^{FsnE2}$, . . . , $e^{FsnEn}$). In this example, the output with respect to the component of the vector $F_{snE}$ means: $y_i=e^{xi}$ (where $y_i$ denotes the i-th component of an output vector, and $x_i$ denotes the i-th component of a vector $F_{snE}$). Further, the right side of Equation 15 may be expressed as $\exp[C^{-1}[F_{snE}]]$, which is an exp function. $C^{-1}[F_{snE}]$ is calculated for each component of an inverse-cosine-transformed vector $F_{snE}$, and is output corresponding to a component of the vector $F_{snE}$. In this example, the expression that the right side is output with respect to a vector component means: $z_i=C^{-1}[x_i]$ (where $z_i$ denotes the i-th component of an output vector, and $x_i$ denotes the i-th component of a vector $F_{snE}$). Further, an exponential operation in Equation 15 is the same as the calculation in Equation 14.

In this example, substituting (Equation 11) in (Equation 15) yields the following mathematical expression.

$$R_{snE}=\exp[C^{-1}[\Sigma_{g=0}^{G-1}P(g|F_{sn1})\mu_{sn,g}]]=\exp[\Sigma_{g=0}^{G-1}P(g|F_{sn1})C^{-1}[\mu_{sn,g}]] \quad \text{(Equation 16)}$$

Inverse cosine transform $C^{-1}$ is a linear transform. In view of the above, a value $C^{-1}[\mu_{sn,g}]$, which is a value obtained by applying inverse cosine transform to an average value $\mu_{sn,g}$ of a priori S/N ratio model $M_{sn}$, is stored and held in advance in the storage unit 205. As far as an average value $\mu_{sn,g}$ of a priori S/N ratio model $M_{sn}$ does not change, in (Equation 16), inverse cosine transform operation is unnecessary by using a operation result $C^{-1}[\mu_{sn,g}]$ of the storage unit 205.

(Noise Suppression Coefficient Calculation Unit)

The noise suppression coefficient calculation unit 203 calculates and outputs a noise suppression coefficient $W_0$ with use of a priori S/N ratio expectation $R_{snE}$. For instance, it is possible to calculate a noise suppression coefficient by a Wiener Filter method as expressed by the following mathematical expression, with use of a priori S/N ratio expectation $R_{snE}$.

$$W_0 = \frac{R_{snE}}{1+R_{snE}} \quad \text{(Equation 17)}$$

The right side of Equation (17) is calculated for each component of a vector $R_{snE}$, and are outputs with respect to the each component of the vector $R_{snE}$ represented by $\{(R_{snE1}/(1+R_{snE1}), (R_{snE2}/(1+R_{snE2}), \ldots, (R_{snEn}/(1+R_{snEn})\}$, for instance. The output with respect to the component of the vector $R_{snE}$ means: $y_i=x_i/(1+x_i)$ (where $y_i$ denotes the i-th component of an output vector, and $x_i$ denotes the i-th component of a vector $R_{snE}$).

Note that it is needless to say that the other noise suppression method such as the MMSE STSA method or the MMSE LSA method may be used when the noise suppression coefficient calculation unit 203 calculates a noise suppression coefficient with use of a priori S/N ratio expectation $R_{snE}$.

When a noise suppression method using an after S/N ratio (a ratio between a mixed signal including a desired signal and noise, and noise) is employed in calculating a noise suppression coefficient, the noise suppression coefficient calculation unit 203 may calculate an after S/N ratio ($X_0/N_1$) from an input signal $X_0$ and first estimated noise $N_1$ in the first a priori S/N ratio estimation unit 201, and may use the after S/N ratio for calculation of a noise suppression coefficient.

(Noise Suppression Unit)

The noise suppression unit 204 suppresses a noise component included in an input signal $X_0$ by multiplying the input signal $X_0$ by a noise suppression coefficient $W_0$, and outputs an estimated value $S_0$ of a desired signal.

$$S_0=W_0X_0 \quad \text{(Equation 18)}$$

Specifically, approximating a priori S/N ratio expectation $R_{snE}$ by a ratio of an estimated value $S_0$ of a desired signal to an estimated value $N_0$ of noise yields approximation: $W_0 \approx S_0/(S_0+N_0)$. Then, $W_0 \times X_0$ becomes an estimated value $S_0$ of a desired signal from $X_0 \approx S_0+N_0$.

FIG. 5 is a flowchart for describing a processing sequence (an operation) of the second example embodiment described referring to FIG. 2 to FIG. 4.

(Step S601)

The first a priori S/N ratio estimation unit 201 estimates a ratio $R_{sn1}$ of a desired signal and noise, which are included in an input signal $X_0$ in which the desired signal and noise are mixed.

(Step S602)

The a priori S/N ratio expectation calculation unit 202 compares between a priori S/N ratio $R_{sn1}$ estimated by the first a priori S/N ratio estimation unit 201, and a priori S/N ratio model $M_{sn}$ in the storage unit 205, and calculates a priori S/N ratio expectation $R_{snE}$, which is a value corrected by the a priori S/N ratio model $M_{sn}$.

(Step S603)

The noise suppression coefficient calculation unit 203 calculates a noise suppression coefficient $W_0$ with use of a priori S/N ratio expectation $R_{snE}$.

(Step S604)

The noise suppression unit 204 suppresses a noise component included in an input signal by multiplying the input signal $X_0$ by a noise suppression coefficient $W_0$, and obtains an estimated value $S_0$ of a desired signal.

According to the example embodiment, a priori S/N ratio $R_{sn1}$ is corrected by a priori S/N ratio model $M_{sn}$ taking into consideration fluctuation of the magnitude of noise. By using a noise suppression coefficient calculated with use of a corrected a priori S/N ratio expectation $R_{snE}$, it is possible to suppress a noise component with high accuracy without removing a desired signal component even when the magnitude of noise fluctuates.

Third Example Embodiment

Figure 6:
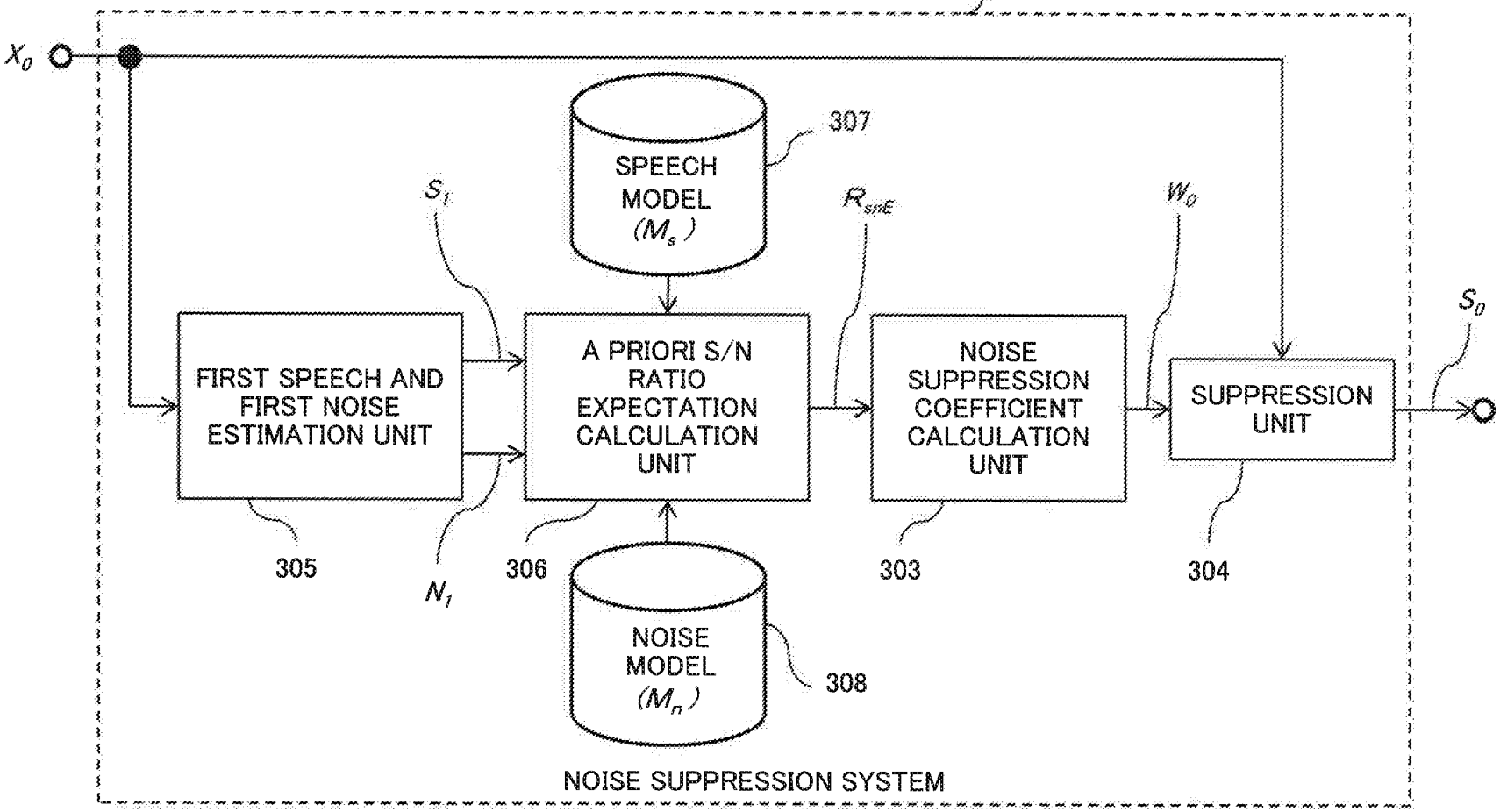
FIG. 6 is a diagram exemplarily illustrating a configuration of a noise suppression system according to a third example embodiment of the present invention.
Figure 7:
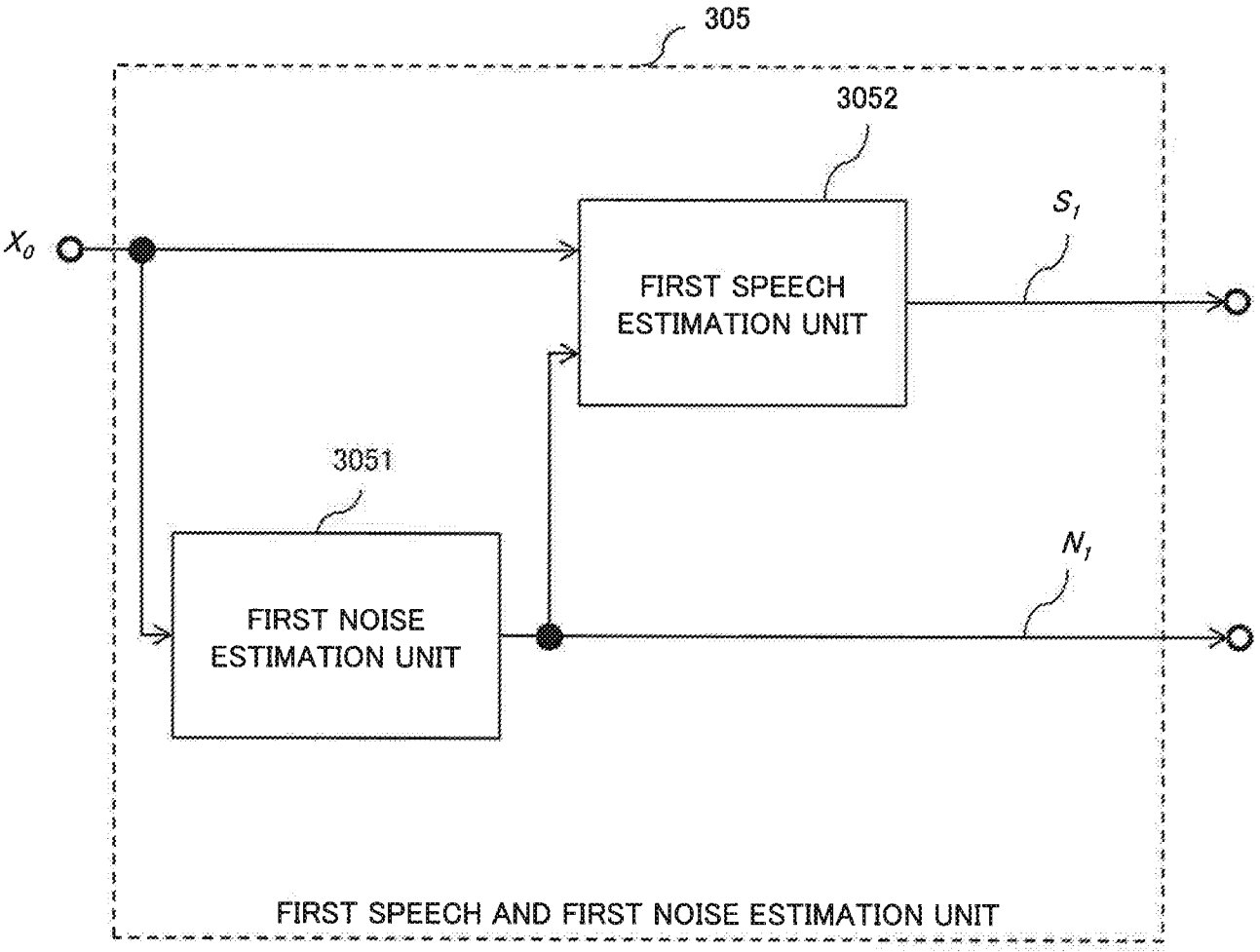
FIG. 7 is a diagram exemplarily illustrating a configuration of a first speech and first noise estimation unit according to the third example embodiment of the present invention.
Figure 8:
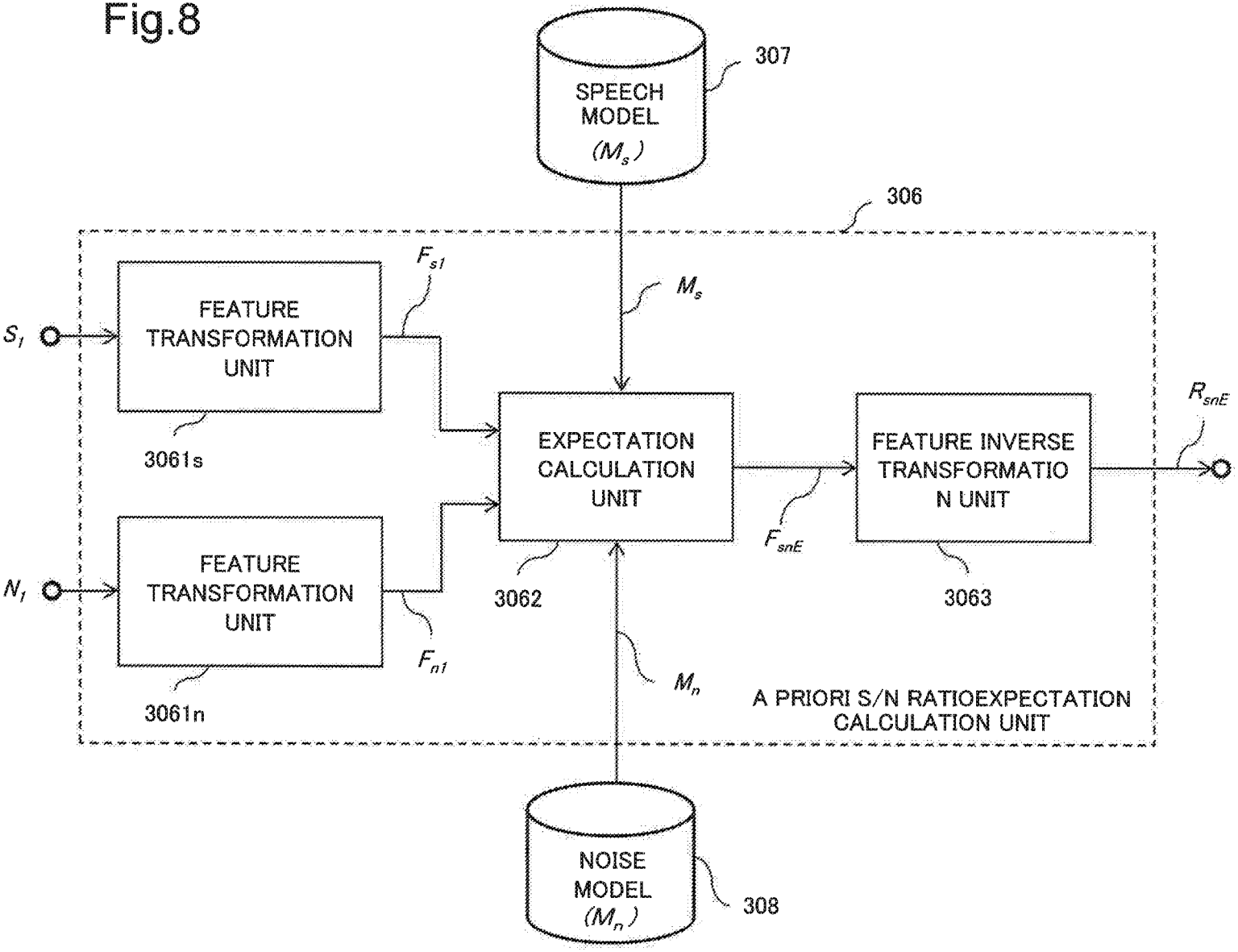
FIG. 8 is a diagram exemplarily illustrating a configuration of an a priori S/N ratio expectation calculation unit according to the third example embodiment of the present invention.

Next, a noise suppression system according to the third example embodiment of the present invention is described referring to FIG. 6, FIG. 7, and FIG. 8. When the noise suppression system 200 according to the second example embodiment illustrated in FIG. 2 is compared with a noise suppression system 300 according to the third example embodiment illustrated in FIG. 6, the third example embodiment is different from the second example embodiment in the following points:

- the first a priori S/N ratio estimation unit 201 in FIG. 2 is replaced by a first speech and first noise estimation unit 305 in FIG. 6;
- the a priori S/N ratio expectation calculation unit 202 in FIG. 2 is replaced by an a priori S/N ratio expectation calculation unit 306 in FIG. 6; and
- the a priori S/N ratio model $M_{sn}$ stored and held in the storage unit 205 in FIG. 2 is a speech model $M_s$ and a noise model $M_n$, which are respectively stored and held in storage units 307 and 308 in FIG. 6.

Note that in FIG. 6 and the like, in order to facilitate the description, a speech model $M_s$ and a noise model $M_n$ are stored and held in individual storage units. It is needless to say, however, that a speech model $M_s$ and a noise model $M_n$ may be stored and held in one storage unit.

The operations of a noise suppression coefficient calculation unit 303 and a noise suppression unit 304 in FIG. 6 are respectively the same as the operations of the noise suppression coefficient calculation unit 203 and the noise suppression unit 204 in FIG. 2. Description on the same portions as those in the second example embodiment illustrated in FIG. 2 is omitted as necessary in order to avoid repeated description. In the following, differences between the example embodiment and the second example embodiment are described. Specifically, in the following, the first speech and first noise estimation unit 305, the a priori S/N ratio expectation calculation unit 306, a speech model $M_s$, and a noise model $M_n$ are described.

The first speech and first noise estimation unit 305 receives an input signal $X_0$ in which a desired signal and noise are mixed. Then, the first speech and first noise estimation unit 305 outputs an estimated value $S_1$ of a first desired signal (speech) and an estimated value $N_1$ of first noise, which are included in the input signal $X_0$.

The a priori S/N ratio expectation calculation unit 306 receives an estimated value $S_1$ of a first desired signal (speech) and an estimated value $N_1$ of first noise output from the first speech and first noise estimation unit 305, and a speech model (a speech pattern) $M_s$ stored and held in advance in the storage unit 307. Further, the a priori S/N ratio expectation calculation unit 306 receives a noise model (a noise pattern) $M_n$ stored and held in advance in the storage unit 308. The a priori S/N ratio expectation calculation unit 306 compares between an estimated value $S_1$ of a desired signal (speech) and an estimated value $N_1$ of noise, and between a speech model $M_s$ and a noise model $M_n$; and outputs a priori S/N ratio expectation $R_{snE}$.

(First Speech and First Noise Estimation Unit)

FIG. 7 is a diagram exemplarily illustrating a configuration of the first speech and first noise estimation unit 305. The first speech and first noise estimation unit 305 includes a first noise estimation unit 3051 and a first speech estimation unit 3052.

The first noise estimation unit 3051 receives an input signal $X_0$, and outputs first estimated noise $N_1$.

The first speech estimation unit 3052 receives an input signal $X_0$ and first estimated noise $N_1$, and outputs first estimated speech $S_1$. The operations of the first noise estimation unit 3051 and the first speech estimation unit 3052 in FIG. 7 are the same as the operations of the first noise estimation unit 2011 and the first speech estimation unit 2012 in FIG. 3, and therefore, description thereof is omitted. Note that out of the outputs from the first speech and first noise estimation unit 305, first estimated noise $N_1$ may be obtained as a re-estimated noise component $N_1'$ with use of an input signal $X_0$ and first estimated speech $S_1$ (refer to the denominator on the right side of (Equation 5)).

(A Priori S/N Ratio Expectation Calculation Unit)

FIG. 8 is a diagram exemplarily illustrating a configuration of the a priori S/N ratio expectation calculation unit 306. The a priori S/N ratio expectation calculation unit 306 includes a feature transformation unit 3061*s*, a feature transformation unit 3061*n*, an expectation calculation unit 3062, and a feature inverse transformation unit 3063.

The feature transformation unit 3061*s* receives first estimated speech $S_1$, and outputs a feature $F_{s1}$ of the first estimated speech $S_1$.

The feature transformation unit 3061*n* receives first estimated noise $N_1$, and outputs a feature $F_{n1}$ of the first estimated noise $N_1$.

The expectation calculation unit 3062 receives a feature $F_{s1}$, a feature $F_{n1}$, a speech model $M_s$ prepared in advance, and a noise model $M_n$ prepared in advance, and outputs a feature $F_{snE}$ of a priori S/N ratio expectation.

The feature inverse transformation unit 3063 receives a feature $F_{snE}$, and outputs a priori S/N ratio expectation $R_{snE}$. The operation of the feature inverse transformation unit 3063 is the same as the operation of the feature inverse transformation unit 2023 in FIG. 4, and therefore, description thereof is omitted.

(Feature Transformation Unit)

The feature transformation unit 3061*s* receives first estimated speech $S_1$, transforms the input first estimated speech $S_1$, and outputs a feature $F_{s1}$. As a feature, it is possible to use a logarithmic value in (Equation 19), a value (cepstrum) obtained by applying cosine transform (discrete cosine transform) to a logarithmic value as expressed by (Equation 20), or the like.

$$F_{s1}=\log S_1 \quad \text{(Equation 19)}$$

Note that the right side of Equation 19, is logarithmically calculated for each component of a vector $S_1$, and are outputs with respect to each component of the vector $S_1$. In this example, the output with respect to the component of the vector means: $y_i=\log x_i$ (where $y_i$ denotes the i-th component of an output vector, and $x_i$ denotes the i-th component of a vector $S_1$).

$$F_{s1}=C[\log S_1] \quad \text{(Equation 20)}$$

Further, the right side of Equation 20 is subjected to cosine transform for each component of a vector log $S_1$, and is output corresponding to a component of a vector $S_1$. In this example, the output with respect to the component the vector $S_1$ means: $z_i=C[x_i]$ (where $z_i$ denotes the i-th component of an output vector, and $x_i$ denotes the i-th component of a vector $S_1$). Further, logarithmic operation of Equation 20 is the same as the calculation in Equation 19.

The feature transformation unit 3061*n* receives first estimated noise $N_1$, transforms the input first estimated noise $N_1$, and outputs a feature $F_{n1}$. As a feature, it is possible to use a logarithmic value in (Equation 21), a value (cepstrum) obtained by applying cosine transform (discrete cosine transform) to a logarithmic value as expressed by (Equation 22), or the like.

$$F_{n1}=\log N_1 \quad \text{(Equation 21)}$$

Note that the right side of Equation 21, is logarithmically calculated for each component of a vector $N_1$, and are outputs with respect to the each component of the vector $N_1$. In this example, the output with respect to the component of the vector $N_1$ means: $y_i=\log x_i$ (where $y_i$ denotes the i-th component of an output vector, and $x_i$ denotes the i-th component of a vector $N_1$).

$$F_{n1}=C[\log N_1] \quad \text{(Equation 22)}$$

Further, the right side of Equation 22 is subjected to cosine transform for each component of a vector log $N_1$, and is output corresponding to the component of the vector $N_1$. The right side of Equation 20 is subjected to cosine transform for each component of a vector log $N_1$, and are outputs with respect to the component of the vector $N_1$. In this example, the output with respect to a vector $N_1$ means: $z_i=C[x_i]$ (where $z_i$ denotes the i-th component of an output vector, and $x_i$ denotes the i-th component of a vector $N_1$). Further, logarithmic operation of Equation 22 is the same as the calculation in Equation 21.

Note that features $F_{s1}$ and $F_{n1}$ may be calculated for each time index t. Alternatively, a difference with respect to a feature at a past time (e.g., t−1) may be obtained, and a primary difference feature may be used. Further alternatively, a further difference may be obtained, and a secondary difference feature may be used. There exist features $F_{s1}$ and $F_{n1}$ at the time index t by the number equal to the number of dimensions of cepstrum, the number of primary difference features, or the number of secondary difference features. Therefore, features $F_{s1}$ and $F_{n1}$ at the time index t is a multi-dimensional vector.

(Expectation Calculation Unit)

The expectation calculation unit 3062 receives:

- a feature $F_{s1}$ output from the feature transformation unit 3061*s;*
- a feature $F_{n1}$ output from the feature transformation unit 3061*n;*
- a speech model $M_s$ stored in the storage unit 307; and
- a noise model $M_n$ stored in the storage unit 308, and
- outputs a feature $F_{snE}$ of a priori S/N ratio expectation.

In the following example, the third example embodiment of the present invention is described based on the premise that:

- a speech model is a Gaussian mixture model constituted by Gaussian distributions whose number is $G_s$; and
- a noise model is a Gaussian mixture model constituted by Gaussian distributions whose number is number $G_n$. It is needless to say, however, that the third example embodiment of the present invention is not limited to the following example.

Taking into consideration that:

- the a priori S/N ratio is a ratio of $S_1$ to $N_1$ as expressed by (Equation 4) to (Equation 8);
- each of the features is a logarithmic value, or a linear transform of the logarithmic value as expressed by (Equation 9) and (Equation 10); and
- each of the features of speech and noise is a logarithmic value, or a linear transform of the logarithmic value as expressed by (Equation 19) to (Equation 22), it is possible to express a feature $F_{sn1}$ of a priori S/N ratio as follows with use of features $F_{s1}$ and $F_{n1}$.

$$F_{sn1}=F_{s1}-F_{n1} \quad \text{(Equation 23)}$$

As described above, in this example, a speech model $M_s$ is a Gaussian mixture model, in which Gaussian distributions whose number is $G_s$ with an average value $\mu_{s,gs}$ and a dispersion $\sigma^2_{s,gs}$ are mixed with a weight $w_{s,gs}$.

Further, a noise model $M_n$ is a Gaussian mixture model, in which Gaussian distributions whose number is $G_n$ with an average value $\mu_{n,gn}$ and a dispersion $\sigma^2_{n,gn}$ are mixed with a weight $w_{n,gn}$.

Note that $g_s$ and $g_n$ are indexes of Gaussian distribution.

In this example, when it is assumed that a speech signal and a noise signal are independent of each other, a priori S/N ratio model is a Gaussian mixture model, in which Gaussian distributions whose number is G ($=G_s \times G_n$) with an average value $\mu_{sn,g}$ ($=\mu_{s,gs}-\mu_{n,gn}$) and a dispersion $\sigma^2_{sn,g}$ ($=\sigma^2_{s,gs}+\sigma^2_{n,gn}$) are mixed with a weight $w_{sn,g}$ ($=w_{s,gs} \times w_{n,gn}$).

The expectation calculation unit 3062 calculates and outputs a feature $F_{snE}$ of an expectation by (Equation 11) in the same manner as the expectation calculation unit 2022 in FIG. 4 with use of:

a feature $F_{sn1}$ ($=F_{s1}-F_{n1}$) of a priori S/N ratio in (Equation 23); and a priori S/N ratio model constituted by a speech model $M_s$ and a noise model $M_n$.

According to the example embodiment, a speech model $M_s$ and a noise model $M_n$ may be held in the storage units (307, 308), in place of the a priori S/N ratio model $M_{sn}$ in the second example embodiment. According to this configuration, the example embodiment is advantageous in reducing a required storage capacity, as compared with the second example embodiment. The reason for this is because A+B<AB is established when the number of speech models $M_s$ is A (A>2), and the number of noise models $M_n$ is B (B>2). For instance, when the number of speech models $M_s$ is three, and the number of noise models $M_n$ is two, the number of a priori S/N ratio models can be six. Specifically, it is possible to reduce the number of models to be stored in a storage unit.

Further, according to the example embodiment, when the system is adapted to a different noise environment, and the like, for instance, it is only necessary to re-generate a noise model $M_n$. This facilitates adaptation to a different noise environment.

Further, according to the example embodiment, when reliability of a feature $F_{n1}$ of noise is instantaneously decreased, such as when speech is instantaneously included in the feature $F_{n1}$ of noise, the feature $F_{n1}$ of noise is substituted by an average value $\mu_{n,gn}$ of a noise model in (Equation 23). This makes it possible to avoid in advance a situation that speech may be inadvertently suppressed as noise. Note that determination as to whether or not a feature $F_{n1}$ of noise is reliable may be performed by comparing between the feature $F_{n1}$ of noise and a noise model $M_n$. For instance, when a feature $F_{n1}$ of noise is within the range: $\mu_{n,gn}\pm3\sigma_{n,gn}$ (where $\mu_{n,gn}$ is an average value of a noise model, and $\sigma_{n,gn}$ is a standard deviation), reliability may be high, and when the feature $F_{n1}$ of noise is out of the range, reliability may be low.

As described above, according to the example embodiment, an expectation of a feature of a priori S/N ratio is calculated with use of a feature of a priori S/N ratio, and a priori S/N ratio model constituted by a speech model and a noise model; and a noise suppression coefficient is obtained from the expectation of the feature of the a priori S/N ratio. The aforementioned configuration provides operational advantages i.e. suppressing a noise component with high accuracy without removing a desired signal component even when the magnitude of noise fluctuates, as well as the other example embodiments. Further, the example embodiment provides new operational advantages i.e. reducing a capacity of a storage device, and facilitating adaptation to a different noise environment.

Fourth Example Embodiment

Figure 9:
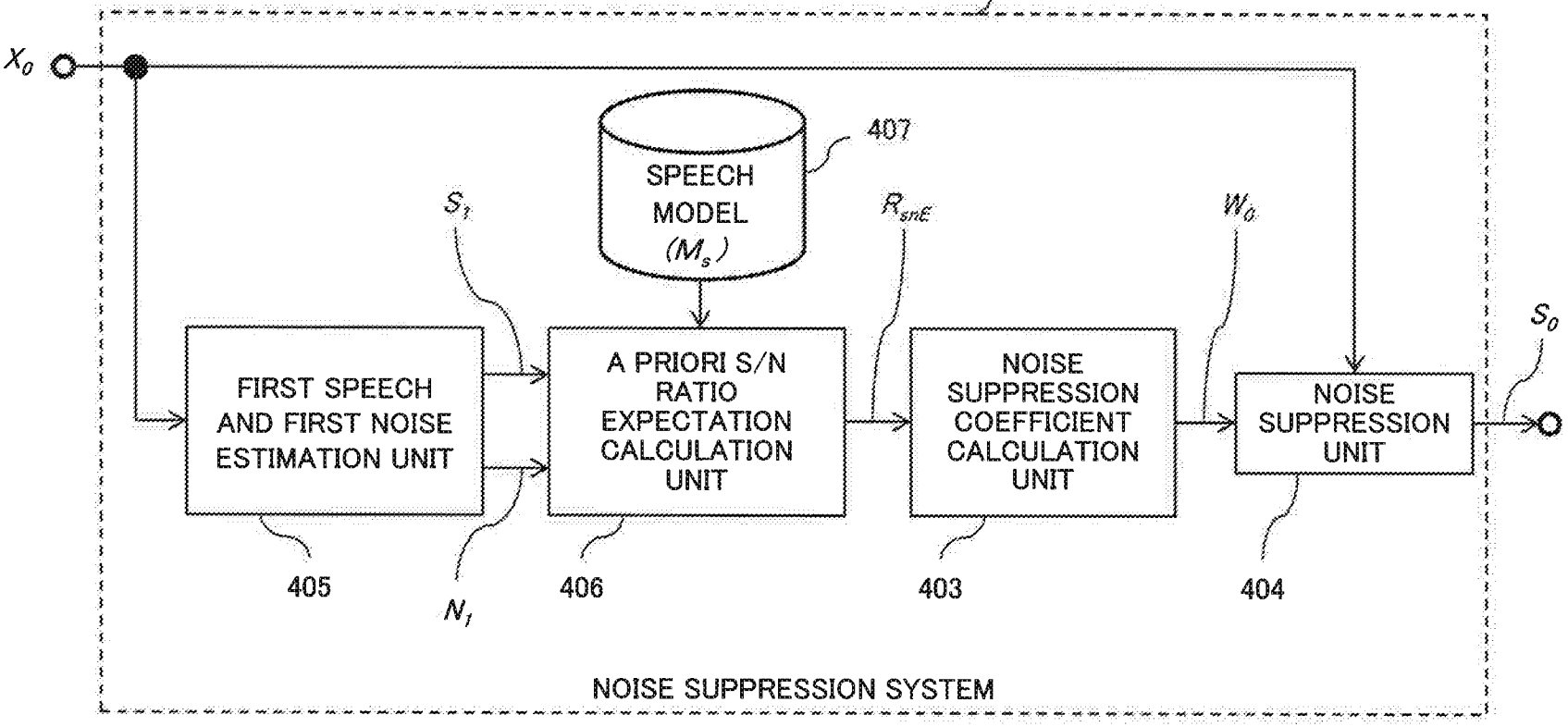
FIG. 9 is a diagram exemplarily illustrating a configuration of a noise suppression system according to a fourth example embodiment of the present invention.
Figure 10:
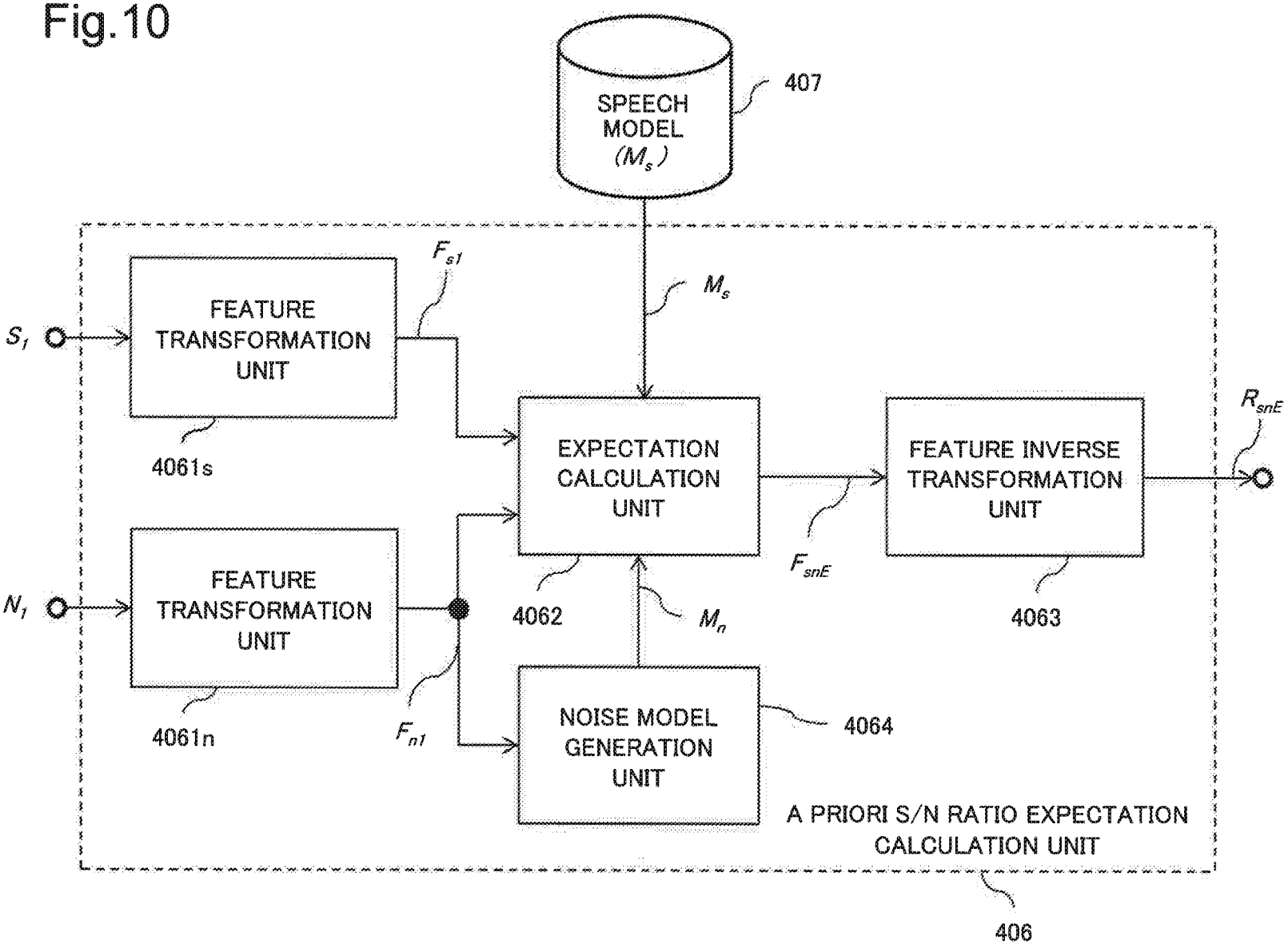
FIG. 10 is a diagram exemplarily illustrating a configuration of an a priori S/N ratio expectation calculation unit according to the fourth example embodiment of the present invention.

A noise suppression system according to a fourth example embodiment of the present invention is described referring to FIG. 9 and FIG. 10. Referring to FIG. 9, the noise suppression system according to the fourth example embodiment is different from the third example embodiment in the points:

the a priori S/N ratio expectation calculation unit 306 in FIG. 6 is replaced by an a priori S/N ratio expectation calculation unit 406 in FIG. 9; and the noise model $M_n$ stored and held in advance in the storage unit 308 in FIG. 6 is unnecessary in FIG. 9.

The operations of a first speech and first noise estimation unit 405, a noise suppression coefficient calculation unit 403, and a noise suppression unit 404 in FIG. 9 are respectively the same operations of the first speech and first noise estimation unit 305, the noise suppression coefficient calculation unit 303, and the noise suppression unit 304 in FIG. 6. Therefore, description on the same portions as those in the third example embodiment illustrated in FIG. 6 is omitted as necessary in order to avoid repeated description. In the following, differences between the example embodiment and the third example embodiment are described. Specifically, in the following, the a priori S/N ratio expectation calculation unit 406 and a noise model $M_n$ are described.

The a priori S/N ratio expectation calculation unit 406 receives output values $S_1$ and $N_1$ of the first speech and first noise estimation unit 405, and a speech model (a speech pattern) $M_s$ prepared in advance. The a priori S/N ratio expectation calculation unit 406 outputs a priori S/N ratio expectation $R_{snE}$ with use of estimated $S_1$ and $N_1$, and a speech model $M_s$.

(A Priori S/N Ratio Expectation Calculation Unit)

FIG. 10 is a diagram exemplarily illustrating a configuration of the a priori S/N ratio expectation calculation unit 406. Referring to FIG. 10, the a priori S/N ratio expectation calculation unit 406 includes a feature transformation unit 4061*s*, a feature transformation unit 4061*n*, an expectation calculation unit 4062, a feature inverse transformation unit 4063, and a noise model generation unit 4064. The noise model generation unit 4064 generates (successively updates) a noise model $M_n$ from a feature $F_{n1}$ of first estimated noise, and inputs the generated noise model $M_n$ to the expectation calculation unit 4062. The operations of the feature transformation unit 4061*s*, the feature transformation unit 4061*n*, and the feature inverse transformation unit 4063 are respectively the same as the operations of the feature transformation unit 3061*s*, the feature transformation unit 3061*n*, and the feature inverse transformation unit 3063 in FIG. 8, and therefore, description thereof is omitted.

(Noise Model Generation Unit)

The noise model generation unit 4064 receives a feature $F_{n1}$ of first estimated noise, generates (successively updates) a noise model $M_n$, and outputs the generated noise model $M_n$. In the following, to simplify the description, a noise model is described as a single Gaussian distribution. Note that it is needless to say that the fourth example embodiment of the present invention is not limited to such a distribution.

A noise model $M_n$ is regarded as a single Gaussian distribution with an average value $\mu_n$ and a dispersion $\sigma^2_n$.

$$\mu_n=\mathrm{AVE}[F_{n1}] \quad \text{(Equation 24)}$$

$$\sigma_n^2=\mathrm{VAR}[F_{n1}] \quad \text{(Equation 25)}$$

Note that AVE[ ] denotes an operator which calculates an average value, and VAR[ ] denotes an operator which calculates a dispersion value. For instance, an average value $\mu_n(t)$ and a dispersion $\sigma^2_n(t)$ of a noise model $M_n$ at the time index t are respectively and successively updated as expressed by the following (Equation 26) and (Equation 27).

$$\mu_n(t)=\alpha_\mu\mu_n(t-1)+(1-\alpha_\mu)F_{n1}(t) \quad \text{(Equation 26)}$$

$$\sigma_n^2(t)=\alpha_\sigma\sigma_n^2(t-1)+(1-\alpha_\sigma)\{F_{n1}(t)-\mu_n(t)\}^2 \quad \text{(Equation 27)}$$

In this example, $\alpha_\mu$ and $\alpha_\sigma$ are respectively a time constant (0.0 to 1.0) for calculating an average value and a dispersion value, and are normally set to a value of from 0.9 to 1.0 for obtaining an averaging effect. Note that it is needless to say that a noise model $M_n$ may be generated by a method other than the aforementioned exemplary method.

(Expectation Calculation Unit)

The expectation calculation unit 4062 receives:

- a feature $F_{s1}$ output from the feature transformation unit 4061*s;*
- a feature $F_{n1}$ output from the feature transformation unit 4061*n;*
- a speech model (a speech pattern) $M_s$ stored and held in advance in a storage unit 407; and
- a noise model (a noise pattern) $M_n$ from the noise model generation unit 4064, and outputs a feature $F_{snE}$ of a priori S/N ratio expectation.

The operation of the expectation calculation unit 4062 is basically the same as the operation of the expectation calculation unit 3062 in FIG. 8.

In this example, when it is difficult to generate a priori S/N ratio model by combining a noise model $M_n$ and a speech model $M_s$ that change momentarily by the expectation calculation unit 4062 in the aspect of the amount of calculation, the amount of calculation may be reduced by performing the following device, for instance.

First of all, an average value $\mu_{sn,g}$ ($=\mu_{s,gs}-\mu_{n,gn}$) of a priori S/N ratio model is considered. In (Equation 13), calculation of a difference between a feature $F_{sn1}$ of a priori S/N ratio and an average value $\mu_{sn,g}$ of a priori S/N ratio model is rewritten with use of an average value $\mu_{s,gs}$ of a speech model and an average value $\mu_{n,gn}$ of a noise model.

$$\{F_{sn1}-\mu_{sn,g}\}=\{F_{sn1}-(\mu_{s,ng}-\mu_{n,ng})\} \quad \text{(Equation 28)}$$

When the number $G_n$ of mixture distributions of a noise model $M_n$ is smaller than the number $G_s$ of mixture distributions of a speech model $M_s$, for instance, when the noise model $M_n$ is regarded as a single Gaussian distribution, the following (Equation 29) is applied.

$$\{F_{sn1}-(\mu_{s,ng}-\mu_n)\}=\{(F_{sn1}+\mu_n)-\mu_{s,ng}\} \quad \text{(Equation 29)}$$

Specifically, a difference between an average value $\mu_{s,gs}$ of a speech model $M_s$, and a value obtained by adding an average value $\mu_n$ of a noise model to a feature $F_{sn1}$ of a priori S/N ratio is calculated. According to this configuration, calculation of an average value of a priori S/N ratio model is unnecessary.

Next, a dispersion $\sigma^2_{sn,g}$ ($=\sigma^2_{s,gs}+\sigma^2_{n,gn}$) of a priori S/N ratio model is considered.

Figure 11:
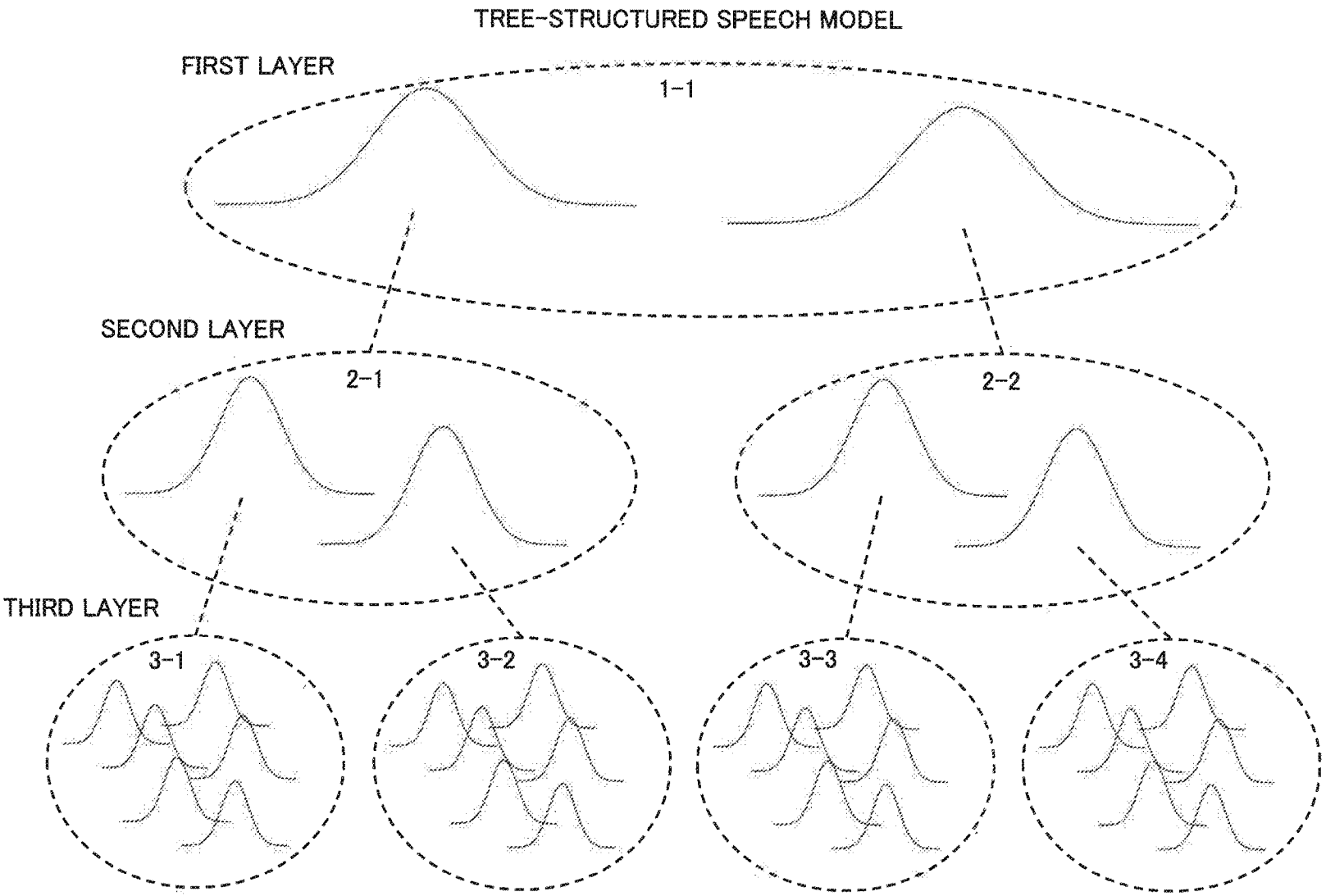
FIG. 11 is a schematic diagram for describing a tree-structured speech model.

As a speech model $M_s$, for instance, a tree-structured speech model as illustrated in FIG. 11 is prepared in advance. In the example of FIG. 11, a Gaussian mixture distribution 1-1 of the first layer is constituted by two Gaussian distributions. The two Gaussian distributions of the first layer are respectively constituted by a Gaussian mixture distribution 2-1 and a Gaussian mixture distribution 2-2 of the second layer. Two distributions of the Gaussian mixture distribution 2-1 (2-2) of the second layer are respectively constituted by Gaussian mixture distributions 3-1 and 3-2 (3-3 and 3-4) of the third layer.

Further, by retrieving a tree structure from an upper layer according to a calculation result of (Equation 13), it is not necessary to calculate a dispersion $\sigma^2_{sn,g}$ of all the a priori S/N ratio models.

Further, when a dispersion $\sigma^2_{n,gn}$ of noise hardly changes, it is possible to reduce the amount of calculation while keeping the accuracy of noise suppression by reducing the calculation frequency of a dispersion $\sigma^2_{sn,g}$ of a priori S/N ratio model.

According to the example embodiment, it is unnecessary to prepare a noise model in advance, because a noise model $M_n$ is generated from an input signal $X_0$.

Further, according to the example embodiment, it is possible to use a noise model suitable for noise included in an input signal $X_0$ by successively updating a noise model $M_n$. As a result, it is possible to suppress noise with high accuracy, as compared with the third example embodiment.

As another example embodiment, the noise suppression system described in the aforementioned example embodiment may be applied to a microphone unit.

Further, the present invention is applicable to a configuration, in which a noise suppression program that implements the functions of the noise suppression systems of the aforementioned example embodiments is supplied directly or remotely to a system or a device. Therefore, the present invention also provides a program to be installed in a computer, a medium storing the program, or a World Wide Web (WWW) server which downloads the program in order to implement the program on the computer. According to the present invention, a non-transitory computer readable medium storing a program which causes a computer to execute the processing steps included in the example embodiments is provided.

The present invention is not limited to the aforementioned example embodiments, but may be configured by combining the example embodiments in various ways, for instance. Further, the present invention may be applied to a system constituted by a plurality of devices, or may be applied to a single device.

Note that each of the disclosures of the aforementioned patent literatures and non-patent literature is incorporated with reference in the present specification. The example embodiments and examples may be modified/adjusted within the scope of all the disclosures of the present invention (including the claims), and based on the basic technical idea of the present invention. Further, a variety of combinations and selections of various disclosure elements (including the elements of the claims, the elements of the examples, the elements of the drawings and the like) are available within the scope of the claims of the present invention. Specifically, it is needless to say that the present invention includes various modifications and amendments, which could have been achieved by a person skilled in the art according to all the disclosures including the claims, and the technical idea.

This application claims the priority based on Japanese Patent Application No. 2014-145753 filed on Jul. 16, 2014, and all of the disclosure of which is hereby incorporated.

REFERENCE SIGNS LIST

100, 200, 300, 400 Noise suppression system
101, 201 First a priori S/N ratio estimation unit
102, 202, 306, 406 A priori S/N ratio expectation calculation unit
103, 203, 303, 403 Noise suppression coefficient calculation unit
104, 204, 304, 404 Noise suppression unit
105, 205 A priori S/N ratio model (storage unit)
305, 405 First speech and first noise estimation unit
307, 407 Speech model (storage unit)
308 Noise model (storage unit)
2011, 3051 First noise estimation unit
2012, 3052 First speech estimation unit
2013 A priori S/N ratio estimation unit

2021, 3061*s*, 3061*n*, 4061*s*, 4061*n* Feature transformation unit
2022, 3062, 4062 Expectation calculation unit
2023, 3063, 4063 Feature inverse transformation unit
4064 Noise model generation unit

What is claimed is:

1. A noise suppression system comprising:

a memory storing instructions; and at least one processor configured to process the instructions to implement:

an a priori S/N ratio estimated value and expectation calculation unit that acquires an expectation of an a priori S/N ratio, by correcting an estimated value of the a priori S/N ratio relating to a signal and a noise based on an a priori S/N ratio model in which fluctuation of a magnitude of noise is treated as a part of a variance element or based on a signal model and a noise model in which fluctuation of the magnitude of noise is treated as a part of a variance element, the signal and the noise being estimated from an input signal in which the signal and the noise are mixed;

a noise suppression coefficient calculation unit that calculates a noise suppression coefficient with use of the expectation of the a priori S/N ratio; and a noise suppression unit that suppresses the noise included in the input signal by multiplying the input signal by the noise suppression coefficient.

2. The noise suppression system according to claim 1, wherein the at least one processor is further configured to process the instructions to implement:

an a priori S/N ratio estimation unit that estimates the signal and the noise from the input signal, and estimates the a priori S/N ratio from the estimated signal and the estimated noise; and an a priori S/N ratio expectation calculation unit that calculates the expectation of the a priori S/N ratio, by correcting the a priori S/N ratio estimated with use of a priori S/N ratio model prepared in advance.

3. The noise suppression system according to claim 1, wherein the at least one processor is further configured to process the instructions to implement:

an estimation unit that estimates the signal and the noise from the input signal; and an a priori S/N ratio expectation calculation unit that calculates the expectation of the a priori S/N ratio, by correcting the a priori S/N ratio relating to the signal and the noise with use of the signal model and the noise model prepared in advance.

4. The noise suppression system according to claim 1, wherein the at least one processor is further configured to process the instructions to implement:

an estimation unit that receives the input signal, and estimates the signal and the noise from the input signal; and an a priori S/N ratio expectation calculation unit that generates the noise model based on the noise, and calculates the expectation of the a priori S/N ratio, by correcting the a priori S/N ratio relating to the signal and the noise with use of the signal model prepared in advance and the noise model generated.

5. The noise suppression system according to claim 3 or 4, wherein the signal model prepared in advance is a tree-structured signal model.

6. A noise suppression method comprising:

acquiring an expectation of an a priori S/N ratio, by correcting an estimated value of an a priori S/N ratio relating to a signal and a noise based on an a priori S/N ratio model in which fluctuation of a magnitude of noise is treated as a part of a variance element or based on a signal model and a noise model in which fluctuation of the magnitude of noise is treated as a part of a variance element, the signal and the noise being estimated from an input signal in which the signal and the noise are mixed;

calculating a noise suppression coefficient with use of the expectation of the a priori S/N ratio; and suppressing the noise component included in the input signal by multiplying the input signal by the noise suppression coefficient.

7. The noise suppression method according to claim 6, further comprising:

estimating the a priori S/N ratio relating to the estimated signal and the estimated noise, wherein the expectation of the a priori S/N ratio value is acquired by correcting the a priori S/N ratio estimated with use of the a priori S/N ratio model prepared in advance.

8. The noise suppression method according to claim 6, wherein the expectation of the a priori S/N ratio is acquired by correcting the a priori S/N ratio relating to the estimated signal and the estimated noise with use of the signal model and the noise model prepared in advance.

9. The noise suppression method according to claim 6, further comprising:

generating the noise model based on the estimated noise, wherein the expectation of the a priori S/N ratio is acquired by correcting a priori S/N ratio relating to the estimated signal and the estimated noise with use of the signal model prepared in advance and the noise model generated.

10. A non-transitory computer readable recording medium storing a program which causes a computer to execute:

acquiring an expectation of an a priori S/N ratio, by correcting to an estimated value of an a priori S/N ratio relating to a signal and a noise based on an a priori S/N ratio model in which fluctuation of a magnitude of noise is treated as a part of a variance element or based on a signal model and a noise model in which fluctuation of the magnitude of noise is treated as a part of a variance element, the signal and the noise being estimated from an input signal in which the signal and the noise are mixed;

calculating a noise suppression coefficient with use of the expectation of the a priori S/N ratio; and suppressing the noise component included in the input signal by multiplying the input signal by the noise suppression coefficient.

11. The noise suppression system according to claim 1, wherein the priori S/N ratio model is constituted by an a priori S/N ratio pattern.

* * * * *